US008556259B2

(12) United States Patent
Suzuki

(10) Patent No.: US 8,556,259 B2
(45) **Date of Patent: *Oct. 15, 2013**

(54) SHEET CONVEYING APPARATUS AND IMAGE FORMING APPARATUS

(71) Applicant: Canon Kabushiki Kaisha, Tokyo (JP)

(72) Inventor: Yohei Suzuki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/750,178

(22) Filed: Jan. 25, 2013

(65) Prior Publication Data

US 2013/0134654 A1 May 30, 2013

Related U.S. Application Data

(62) Division of application No. 13/249,399, filed on Sep. 30, 2011, now Pat. No. 8,387,975.

(30) Foreign Application Priority Data

Oct. 13, 2010 (JP) ..... 2010-230415

(51) Int. Cl.
*B65H 9/04* (2006.01)
*B65H 7/02* (2006.01)
*B65H 43/00* (2006.01)

(52) U.S. Cl.
USPC . 271/243; 271/245; 271/258.01; 271/265.01; 271/176

(58) Field of Classification Search
USPC ..... 271/243, 245, 258.01, 265.01, 176
See application file for complete search history.

(56) References Cited

U.S. PATENT DOCUMENTS

| | | | |
|---|---|---|---|
| 8,172,227 | B2 | 5/2012 | Furusawa et al. |
| 2005/0133992 | A1 | 6/2005 | Ueng et al. |
| 2007/0075484 | A1 | 4/2007 | Terada |
| 2008/0143045 | A1 | 6/2008 | Yu et al. |
| 2012/0181741 | A1 | 7/2012 | Suzuki |

FOREIGN PATENT DOCUMENTS

| | | |
|---|---|---|
| JP | 5-92825 | 4/1993 |
| JP | 6-156810 | 6/1994 |
| JP | 6-171794 | 6/1994 |
| JP | 6-263284 | 9/1994 |
| JP | H09-183539 | 7/1997 |

*Primary Examiner* — David H Bollinger
(74) *Attorney, Agent, or Firm* — Fitzpatrick, Cella, Harper & Scinto

(57) ABSTRACT

A sheet conveying apparatus including, a conveying portion conveying a sheet; a rotation detection portion rotatably provided; a sensor portion detecting the conveyed sheet based on a rotational position of the rotation detection portion; a rotation transmission portion transmitting a rotational driving force to the rotation detection portion to rotate the rotation detection portion in a predetermined rotational direction after the rotation detection portion is rotated by being pushed by the leading end of the sheet; and an urging unit configured to apply an urging force to the rotation detection portion so that the rotation detection portion comes into contact with a surface of the sheet, thereafter the rotation detection portion is returned to a waiting position along with the passage of the rear end of the sheet through the rotation detection portion after the rotation detection portion is rotated by the rotational driving force of the rotation transmitting unit.

20 Claims, 31 Drawing Sheets

SHEET CONVEYING APPARATUS AND IMAGE FORMING APPARATUS

This is a divisional of U.S. patent application Ser. No. 13/249,399, filed Sep. 30, 2011, and allowed on Dec. 6, 2012.

BACKGROUND OF THE INVENTION

1. Field of the Invention

The present invention relates to a sheet conveying apparatus and an image forming apparatus having the same, and more particularly to an image forming apparatus having a sheet conveying apparatus which can detect a leading end position of a sheet to be conveyed.

2. Description of the Related Art

In general, the image forming apparatus provides a sheet conveying portion with a sheet detection portion detecting a leading end position of a sheet in order to match the time to send the sheet to an image transfer position with the time to send an image (toner image) to the image transfer position. The image forming apparatus provides the sheet conveying portion with a plurality of sheet detection portions to detect a sheet conveying state along a sheet conveying path such as a sheet conveyance delay and a jam (see Japanese Patent Application Laid-Open No. H09-183539).

FIGS. 30 to 31B illustrate a conventionally general sheet detection portion. As illustrated in FIG. 30, a conventional sheet detection portion includes a sensor flag 523 and an optical sensor 524. The sheet detection portion is arranged on a downstream side in a sheet conveying direction of a sheet conveying roller pairs 518, 519 closest to an image transfer position. The sensor flag 523 includes a rotating shaft 527 rotating the sensor flag 523; a light shielding portion 525 shielding an optical path L from a light emitting portion to a light receiving portion of the optical sensor 524; a stopper portion 526 positioning the sensor flag 523 to a home position; and a return spring 528. Even if the sensor flag 523 rotates, the sensor flag 523 returns to the home position by its own weight or a pressing force of the return spring 528.

As illustrated in FIG. 31A, when a leading end of a sheet S contacts the sensor flag 523, the sensor flag 523 rotates from the home position to a direction indicated by an arrow M1 around the rotating shaft 527 and the light shielding portion 525 shields the optical path L of the optical sensor 524. When the optical sensor 524 detects that the optical path L is shielded, the sheet detection device recognizes that the leading end of the sheet S reaches the sensor flag 523. FIG. 31B illustrates a state in which the sheet is passing through and in contact with the sensor flag 523. When a trailing end of the sheet S passes through the sensor flag 523, the sensor flag 523 returns to the home position illustrated in FIG. 31A. At this time, the light shielding portion 525 retracts from the optical path L, allowing the light receiving portion of the optical sensor 524 to receive light emitted from the light emitting portion again. Then, the sheet detection device recognizes that the trailing end of the sheet S has passed through the sensor flag 523. In recent years, the image forming apparatus has been required to meet user demand to further improve throughput. In order to improve throughput of the image forming apparatus, it is needed to increase a sheet conveying speed or shorten an interval from the trailing end of a preceding sheet to the leading end of a subsequent sheet (hereinafter referred to as a sheet gap). Consequently, the sheet detection device needs to return the sensor flag to the home position in a short sheet gap after the preceding sheet has passed The conventional sensor flag 523 operates such that when the leading end of the sheet S passed through the conveying roller pair abuts against an abutting portion, the sensor flag is pushed by the sheet S to rotate, and when the trailing end of the sheet moves away from the abutting portion, the sensor flag reversely rotates to return to a home position P. Consequently, the distance required for the sheet gap is a distance D3 obtained by adding a distance D1 from a position in which the trailing end of the preceding sheet passes through the abutting portion of the sensor flag to the home position P in which the leading end of the subsequent sheet abuts against the abutting portion to a distance D2 between which the subsequent sheet is conveyed (see FIG. 31B).

The distance D2 is a distance obtained by multiplying a time $\Delta t$ during which the sensor flag 523 moves across the distance D1 by a sheet conveying speed V ($\Delta t \times V$). When the sensor flag 523 reciprocates, the distance D1 for the sensor flag 523 to return to the home position P is needed, and the higher the sheet conveying speed, the longer the distance D2 for the subsequent sheet to be conveyed during the return movement. Thus, the conventional sheet detection device has a problem in that an increase in the sheet conveying speed increases the sheet gap distance, which inhibits further improvement in throughput.

SUMMARY OF THE INVENTION

The present invention provides a sheet conveying apparatus inhibiting an increase in sheet gap distance while increasing a sheet conveying speed to improve throughput, and an image forming apparatus having the same.

The present invention provides a sheet conveying apparatus including: a conveying portion configured to convey a sheet; a rotation detection portion rotatably provided and having an abutting portion which abuts against a leading end of the sheet conveyed by the conveying portion at a waiting position, wherein the rotation detection portion is rotated in a predetermined rotational direction by being pushed by the leading end of the conveyed sheet; a sensor portion detecting the conveyed sheet based on a rotational position of the rotation detection portion; a rotation transmission portion configured to transmit a rotational driving force to the rotation detection portion to rotate the rotation detection portion in the predetermined rotational direction after the rotation detection portion is rotated by being pushed by the leading end of the conveyed sheet; and an urging unit configured to apply an urging force to the rotation detection portion, wherein after the rotation detection portion is rotated by the rotational driving force of the rotation transmission portion, the urging unit applies the urging force to the rotation detection portion so that the rotation detection portion comes into contact with a surface of the sheet, thereafter the rotation detection portion is returned to the waiting position along with the passage of the rear end of the sheet through the rotation detection portion.

The present invention can shorten the time needed from when the sheet passes to when the rotation detection portion is positioned in the standby position, thereby reducing the need to secure a long distance required for a sheet gap distance and thus improving throughput.

Further features of the present invention will become apparent from the following description of exemplary embodiments with reference to the attached drawings.

DESCRIPTION OF THE EMBODIMENTS

Embodiments of the present invention will now be described in detail in accordance with the accompanying drawings.

Now, an image forming apparatus having a sheet conveying apparatus according to embodiments of the present invention will be described referring to the accompanying drawings. The image forming apparatus according to the embodiments of the present invention is an image forming apparatus, such as a copier, a printer, a fax machine and a combined machine thereof, which has a sheet detection function of detecting a leading end of a sheet to be conveyed. The following embodiments will be described using an electrophotographic image forming apparatus 100 forming a four-color toner image.

<First Embodiment>

Figure 1:
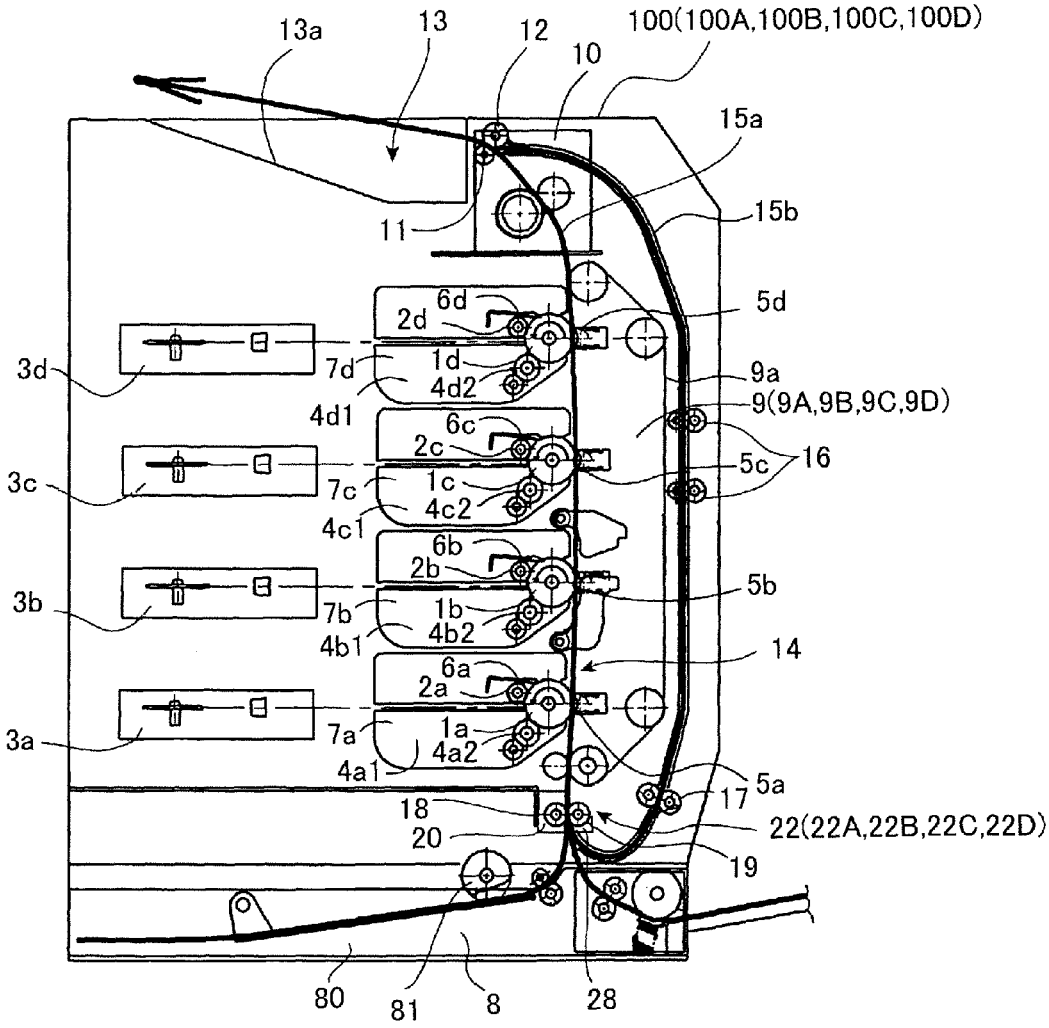
FIG. 1 is a sectional view schematically illustrating an entire structure of an image forming apparatus according to a first embodiment of the present invention.

The image forming apparatus 100 according to a first embodiment of the present invention will be described referring to FIGS. 1 to 10D. First, referring to FIG. 1, an entire structure of the image forming apparatus 100 according to the first embodiment will be described. FIG. 1 is a sectional view schematically illustrating the entire structure of the image forming apparatus 100 according to the first embodiment of the present invention.

As illustrated in FIG. 1, the image forming apparatus 100 according to the first embodiment includes: a sheet feeding portion 8 feeding a sheet S; an image forming portion 14 forming a toner image; a fixing portion 10 fixing a transferred unfixed toner image; and a sheet conveying portion 9 as a sheet conveying apparatus. Further, the image forming apparatus 100 includes a sheet discharging portion 13 discharging the sheet S with the toner image fixed thereon.

The sheet feeding portion 8 includes: a paper feed cassette 80 storing sheets S; a feed roller 81 feeding the sheets S stored in the paper feed cassette 80 to the sheet conveying portion 9; and a separation portion (not illustrated) separating the sheets S one by one. The sheet feeding portion 8 uses the separation portion to separate the sheets S stored in the paper feed cassette 80 one by one which is fed to the sheet conveying portion 9 by the feed roller 81.

The image forming portion 14 forms a toner image based on predetermined image information and transfers the toner image to the sheet S to be conveyed on the sheet conveying portion 9. The image forming portion 14 includes: photosensitive drums 1*a*, 1*b*, 1*c* and 1*d*; charging portions 2*a*, 2*b*, 2*c* and 2*d*; exposure portions 3*a*, 3*b*, 3*c* and 3*d*; developing portions 4*a*, 4*b*, 4*c* and 4*d*; transfer rollers 5*a*, 5*b*, 5*c* and 5*d*; and cleaning portions 6*a*, 6*b*, 6*c* and 6*d*. Further, the image forming portion 14 includes a transfer belt 9*a*.

Each of the photosensitive drums 1*a*, 1*b*, 1*c* and 1*d* as an image bearing member is made by applying an organic photoconductive layer (OPC) to an outer peripheral surface of an aluminum cylinder. Each end portion of the photosensitive drums 1*a*, 1*b*, 1*c* and 1*d* is rotatably supported by a flange. When a driving force is transmitted from a drive motor (not illustrated) to one end portion, the respective photosensitive drums are rotatably driven counterclockwise in FIG. 1. The charging portions 2*a*, 2*b*, 2*c* and 2*d* uniformly charge respective surfaces of the photosensitive drums 1*a*, 1*b*, 1*c* and 1*d* by abutting respective roller-shaped conductive rollers against the respective surfaces of the photosensitive drums 1*a*, 1*b*, 1*c* and 1*d* and causing a power supply (not illustrated) to apply a charge bias voltage thereto. The exposure portions 3*a*, 3*b*, 3*c* and 3*d* irradiate laser beams based on the image information to form respective electrostatic latent images on the photosensitive drums 1*a*, 1*b*, 1*c* and ld.

The developing portions 4*a*, 4*b*, 4*c* and 4*d* include toner containing portions 4*a*1, 4*b*1, 4*c*1 and 4*d*1; and development roller portions 4*a*2, 4*b*2, 4*c*2 and 4*d*2 respectively. The toner containing portions 4*a*1, 4*b*1, 4*c*1 and 4*d*1 respectively contain black toner, cyan toner, magenta toner and yellow toner. The development roller portions 4*a*2, 4*b*2, 4*c*2 and 4*d*2 are adjacently arranged on the respective surfaces of the photosensitive members. Each development roller portion applies a development bias voltage to cause a color toner to adhere to respective electrostatic latent images on the photosensitive drums 1*a*, 1*b*, 1*c* and 1*d* to visualize the respective toner images.

The transfer rollers 5*a*, 5*b*, 5*c* and 5*d* are arranged inside the transfer belt 9*a* so as to abut against the transfer belt 9*a* facing the photosensitive drums 1*a*, 1*b*, 1*c* and 1*d* respectively. The transfer rollers 5*a*, 5*b*, 5*c* and 5*d* are connected to a transfer bias power supply (not illustrated). A positive charge is applied from the transfer rollers 5*a*, 5*b*, 5*c* and 5*d* to the sheet S through the transfer belt 9*a*. This electric field causes the respective negative color toner images on the photosensitive drums 1*a*, 1*b*, 1*c* and 1*d* to be sequentially transferred to the sheet S being in contact with the photosensitive drums 1*a*, 1*b*, 1*c* and ld, thus forming a color image. The cleaning portions 6*a*, 6*b*, 6*c* and 6*d* remove a toner remaining on the respective surfaces of the photosensitive drums 1*a*, 1*b*, 1*c* and 1*d* after transfer.

According to the present embodiment, the photosensitive drums 1*a*, 1*b*, 1*c* and ld, the charging portions 2*a*, 2*b*, 2*c* and 2*d*, the developing portions 4*a*, 4*b*, 4*c* and 4*d*, and the cleaning portions 6*a*, 6*b*, 6*c* and 6*d* integrally form process cartridge portions 7*a*, 7*b*, 7*c* and 7*d* respectively.

The fixing portion 10 heats the sheet S with an unfixed toner image transferred thereto to fix the unfixed toner image. The sheet discharging portion 13 includes a discharging roller pair 11, 12 conveying the sheet S with the image formed thereon by normal rotation or inverting the sheet S by reverse rotation; and a discharge portion 13*a* onto which the sheet S with the image formed thereon is discharged.

The sheet conveying portion 9 conveys the sheet S with the toner image formed by the image forming portion 14. The sheet conveying portion 9 includes a sheet conveying path 15*a*, a duplex conveying path 15*b*, an oblique feed roller pair 16, a U-turn roller pair 17, a paper feed frame 20, a guide frame 28, a conveying roller pair 18, 19 as a conveying portion, and a sheet detection portion 22.

The sheet conveying path 15*a* is a conveying path for conveying the sheet S fed from the sheet feeding portion 8 and the sheet S conveyed from the duplex conveying path 15*b*, and the toner image formed by the image forming portion 14 is transferred in a predetermined position therein. The duplex conveying path 15*b* is a conveying path for re-conveying the sheet S inverted by the discharging roller pair 11, 12 to the sheet conveying path 15*a* for duplex printing. The oblique feed roller pair 16 is arranged along the duplex conveying path 15*b* to convey the inverted sheet S. The U-turn roller pair 17 is arranged in the duplex conveying path 15*b* to re-convey the sheet S conveyed through the duplex conveying path 15*b* to the sheet conveying path 15*a*.

The paper feed frame 20 and the guide frame 28 are arranged near an upstream side of the image forming portion 14 along the sheet conveying path 15*a*. The conveying roller pairs 18, 19 are arranged on the sheet conveying path 15*a* to convey the sheet S passing through the paper feed frame 20 and the guide frame 28 to the image forming portion 14. The conveying roller pairs 18, 19 includes a plurality of conveying rollers 19 and a plurality of conveying rotary members 18 facing the plurality of conveying rollers 19. The conveying rollers 19 are fixed to a rotating shaft 19*a* rotatably supported parallel to a rotating shaft direction of the photosensitive drums 1*a*, 1*b*, 1*c* and ld, and rotate integrally with the rotating shaft 19*a*. The conveying rotary members 18 are rotatably supported to the paper feed frame 20. The conveying rotary members 18 are biased to the conveying rollers 19 by a conveying rotary member spring 21 attached to the paper feed frame 20. This biasing force allows the conveying rotary members 18 to rotate following the conveying rollers 19 to convey the sheet S.

The sheet detection portion 22 is arranged on a downstream side in the sheet conveying direction than the conveying roller pair 18, 19 on the sheet conveying path 15*a*. The sheet detection portion 22 detects a leading end position of the sheet S conveyed to the image forming portion 14 by the conveying roller pair 18, 19.

The sheet S is fed from the sheet feeding portion 8 to the sheet conveying path 15*a* and then conveyed by the conveying roller pair 18, 19 to the image forming portion through the sheet detection portion 22. The sheet detection portion 22 detects a leading end position of the sheet S. When the leading end position is detected by the sheet detection portion 22, the image forming portion 14 starts to form a toner image. When the sheet S passes through the transfer rollers 5*a*, 5*b*, 5*c* and 5*d* following the start of the toner image formation, the respective color toner images on the photosensitive drums 1*a*, 1*b*, 1*c* and 1*d* are sequentially transferred to the sheet S. Then, the fixing portion 10 fixes unfixed toner images to the sheet S, and the sheet S is discharged by the discharging roller pair 11, 12 to the discharge portion 13*a*.

When performing the duplex printing, the fixing portion 10 fixes the unfixed toner images to the sheet S, and then the discharging roller pair 11, 12 reversely rotates before the sheet S is discharged by the discharging roller pair 11, 12 to the discharge portion 13*a*. Thus, the sheet S is conveyed to the duplex conveying path 15*b*. The sheet S conveyed along the duplex conveying path 15*b* passes through the sheet detection portion 22 by the oblique feed roller pair 16 and the U-turn roller pair 17, and the sheet S is conveyed again to the image forming portion 14 to perform duplex printing.

Figure 2A:
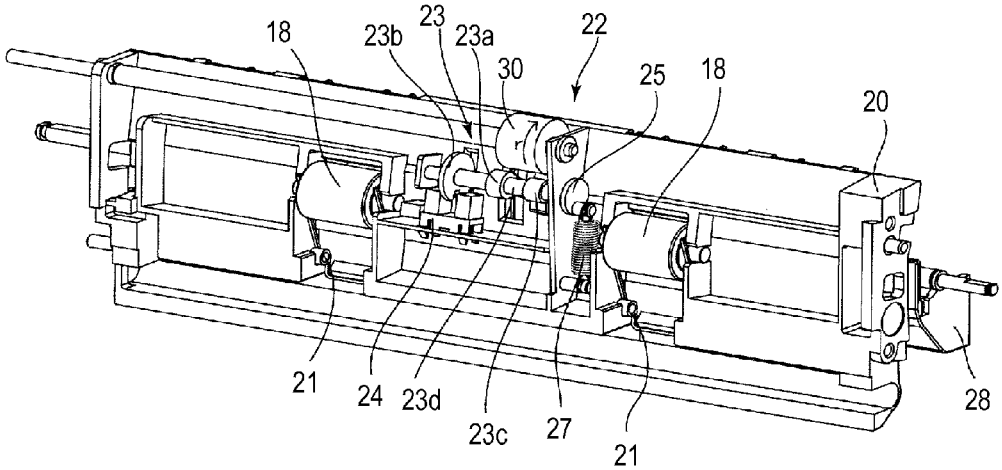
FIG. 2A is a perspective view illustrating a sheet detection portion supported by a paper feed frame according to the first embodiment.
Figure 2B:
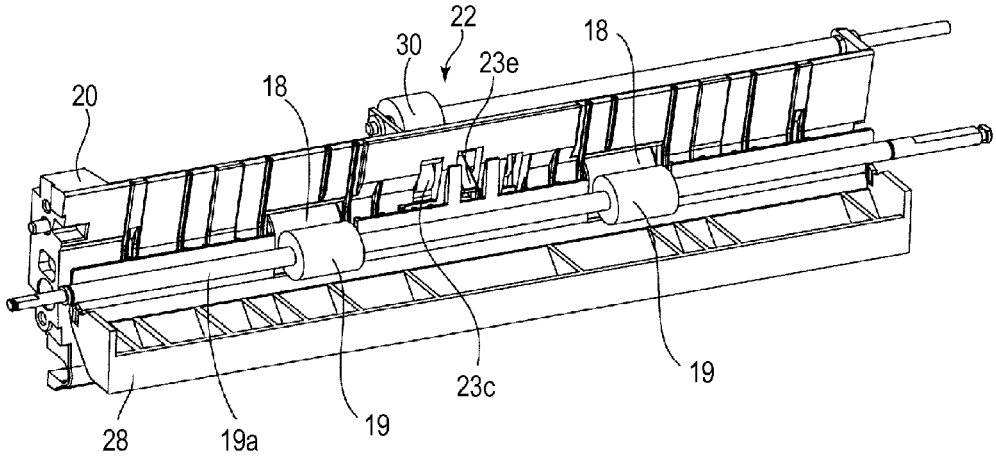
FIG. 2B is a perspective view illustrating the sheet detection portion viewed from an opposite side thereof illustrated in FIG. 2A.
Figure 3:
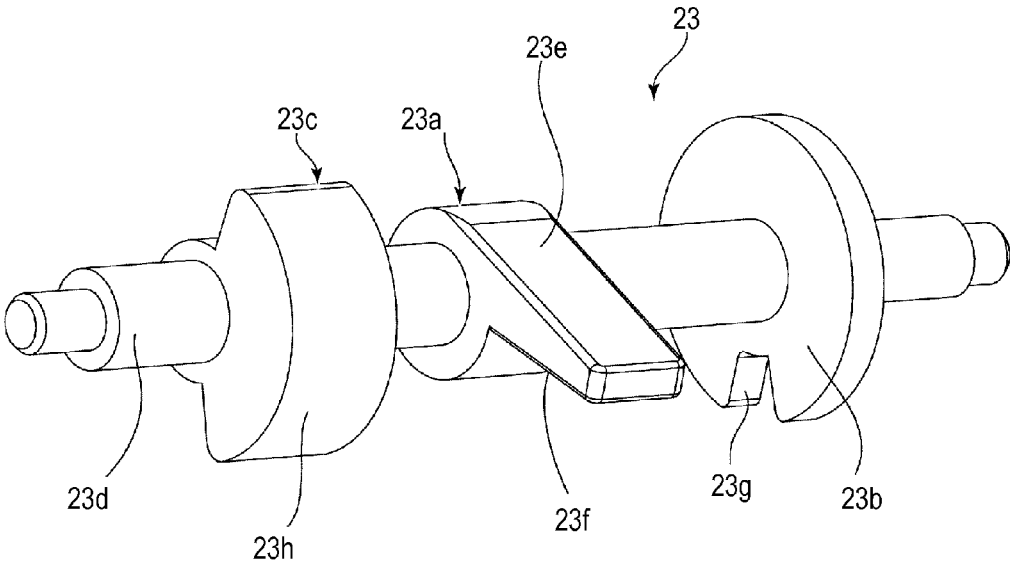
FIG. 3 is a perspective view illustrating a sensor flag of the sheet detection portion according to the first embodiment.

Now, referring to FIGS. 2A to 3, the sheet detection portion 22 detecting the leading end position of the sheet S will be specifically described. FIG. 2A is a perspective view illustrating the sheet detection portion 22 supported by the paper feed frame according to the first embodiment. FIG. 2B is a perspective view illustrating the sheet detection portion 22 viewed from an opposite side thereof illustrated in FIG. 2A. FIG. 3 is a perspective view illustrating a sensor flag 23 of the sheet detection portion 22 according to the first embodiment.

As illustrated in FIGS. 2A and 2B, the sheet detection portion 22 includes: a sensor flag 23; an optical sensor 24 as a sensor portion; a shutter driving portion 25; a shutter spring 27 as a biasing portion; and a rotation assist roller 30 as a rotation portion generating a driving force. According to the present embodiment, an assist cam 23*c* and the rotation assist roller 30 constitute a rotation transmission portion.

The sensor flag 23 is supported by the paper feed frame 20 so as to be positioned on a downstream side of the conveying roller pair 18, 19 near the image forming portion 14. As illustrated in FIG. 3, the sensor flag 23 includes: a shutter flag 23*a* as a rotation detection portion; a light shielding portion 23*b* as a rotation detection portion; the assist cam 23*c* as a transmission portion; and a flag rotating shaft 23*d* rotatably supported by the paper feed frame 20.

The flag rotating shaft 23*d* is arranged parallel to the rotating shaft of the photosensitive drums 1*a*, 1*b*, 1*c* and 1*d*, rotatably supported by the paper feed frame 20, and located on a downstream side of the conveying roller pair 18, 19. The shutter flag 23*a* is fixed to the flag rotating shaft 23*d*, and rotates integrally with the flag rotating shaft 23*d* around the flag rotating shaft 23*d*. Further, the shutter flag 23*a* has an abutting portion 23*e* which is located on a downstream side of the conveying roller pair 18, 19, extends toward a nip portion of the conveying roller pair 18, 19 and can abut against the leading end of the sheet S to be conveyed by the conveying roller pair 18, 19 (see FIGS. 2A and 2B). The abutting portion 23*e* has an abutment surface 23*f* abutting against the leading end of the sheet S to be conveyed from the conveying roller pair 18, 19. When the abutment surface 23*f* of the abutting portion 23*e* is pushed by the leading end of the sheet S, the shutter flag 23*a* rotates around the flag rotating shaft 23*d*.

The light shielding portion 23*b* shields an optical path L of the optical sensor. The light shielding portion 23*b* is fixed to the flag rotating shaft 23*d* and rotates integrally with the flag rotating shaft 23*d* around the flag rotating shaft 23*d*. Further, the light shielding portion 23*b* has a slit portion 23*g* allowing passage of light from the optical sensor 24. The slit portion 23*g* is formed so as to allow passage of light from the optical sensor 24 when the abutment surface 23*f* of the abutting portion 23*e* provided in the shutter flag 23*a* is positioned at a waiting position (hereinafter also referred to as a "home position") of abutting against the sheet S (see FIG. 4D described later). More specifically, when the shutter flag 23*a* rotates by being pushed by the leading end of the sheet S, the light shielding portion 23*b* shields the optical path L of the optical sensor 24. Hereinafter, the position of the sensor flag 23 (see FIGS. 4A to 4D) in which the abutment surface 23*f* of the abutting portion 23*e* is positioned at the home position so as to cause the leading end of the sheet S to abut against the abutment surface 23*f* is referred to as a standby position of the sensor flag 23. The urging force of the shutter spring 27 acts to maintain that the sensor flag 23 is located in the home position.

The assist cam 23*c* is fixed to the flag rotating shaft 23*d* and rotates integrally with the flag rotating shaft 23*d* around the flag rotating shaft 23*d*. Further, the assist cam 23*c* has an engaging portion 23*h* engageable with the rotation assist roller 30. The engaging portion 23*h* engages with the rotation assist roller 30 after the abutment surface 23*f* of the shutter flag 23*a* is pushed by the sheet S to rotate up to a predetermined rotational position until a drive projection portion 25*b* (described later) of the shutter driving portion 25 rotates over the top dead center. The predetermined rotational position refers to a rotational position at which rotation of the shutter flag 23*a* causes rotation of the light shielding portion 23*b*, causing the optical path L of the optical sensor 24 to be shielded by the light shielding portion 23*b*.

The optical sensor 24 is arranged in a rotation path of the light shielding portion 23*b*. The optical sensor 24 includes a light emitting portion emitting light; and a light receiving portion receiving the light emitted from the light emitting portion. The light emitted from the light emitting portion is received by the light receiving portion to form the optical path L. When the light shielding portion shields the light emitted from the light emitting portion, a signal (light signal) output from the light emitting portion is shielded, and the received signal changes. The shutter driving portion 25 is connected to an end portion of the flag rotating shaft 23*d*. The shutter driving portion 25 includes a disc-shaped drive base portion 25*a*, and the drive projection portion 25*b* to which one end of the shutter spring 27 is attached. The drive base portion 25*a* is connected to the flag rotating shaft 23*d* such that the central axis matches the flag rotating shaft 23*d*. The drive base portion 25*a* rotates with the flag rotating shaft 23*d*. The drive projection portion 25*b* is attached to an upper surface of the drive base portion 25*a* such that the drive projection portion 25*b* rotates along an outer periphery of the drive base portion 25*a* around the flag rotating shaft 23*d* when rotation of the flag rotating shaft 23*d* rotates the drive base portion 25*a*. The drive projection portion 25*b* is attached to the drive base portion 25*a* such that the abutment surface 23*f* of the shutter flag 23*a* is positioned at the home position at the bottom dead center.

One end of the shutter spring 27 is attached to the drive projection portion 25*b* and the other end thereof is attached to the paper feed frame 20. The shutter spring 27 biases the drive projection portion 25*b* such that the abutment surface 23*f* of the shutter flag 23*a* is positioned at the home position. Specifically, the shutter spring 27 biases the drive projection portion 25*b* such that the abutting portion 23*e* of the shutter flag 23*a* is positioned at the home position at the bottom dead center of the drive projection portion 25*b*, that is, the sensor flag 23 is positioned at the standby position.

The rotation assist roller 30 is arranged parallel to the rotating shaft direction of the photosensitive drums 1*a*, 1*b*, 1*c* and 1*d* and is rotatably supported by the paper feed frame 20. Further, the rotation assist roller 30 is rotated by an not-illustrated drive portion (motor) in a direction indicated by an arrow r as illustrated in FIG. 2A.

Figure 4A:
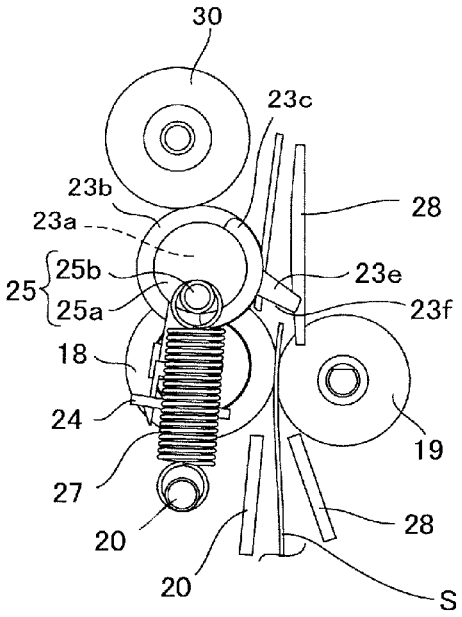
FIG. 4A illustrates the sheet detection portion according to the first embodiment.

Referring to FIGS. 4A to 10D, the operation of the sheet detection portion 22 will be described. FIG. 4A illustrates the sheet detection portion 22 according to the first embodiment. FIG. 4B illustrates the assist cam 23*c* and the rotation assist roller 30 in a state illustrated in FIG. 4A. FIG. 4C illustrates the abutting portion 23*e* of the shutter flag 23*a* in a state illustrated in FIG. 4A. FIG. 4D illustrates the light shielding portion 23*b* in a state illustrated in FIG. 4A. FIG. 5A illustrates a state in which the sheet S abuts against the shutter flag 23*a*. FIG. 5B illustrates the assist cam 23*c* and the rotation assist roller 30 in a state illustrated in FIG. 5A. FIG. 5C illustrates the abutting portion 23*e* of the shutter flag 23*a* in a state illustrated in FIG. 5A. FIG. 5D illustrates the light shielding portion 23*b* in a state illustrated in FIG. 5A. FIG. 6A illustrates a state in which the sensor flag 23 rotates to shield the optical path L of the optical sensor 24. FIG. 6B illustrates the assist cam 23*c* and the rotation assist roller 30 in a state illustrated in FIG. 6A. FIG. 6C illustrates the shutter flag 23*a* in a state illustrated in FIG. 6A. FIG. 6D illustrates the light shielding portion 23*b* in a state illustrated in FIG. 6A.

Figure 7A:
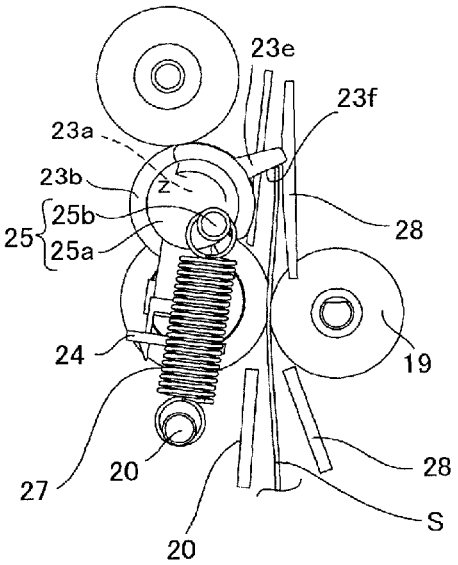
FIG. 7A illustrates a state in which the assist cam engages with the rotation assist roller.
Figure 7B:
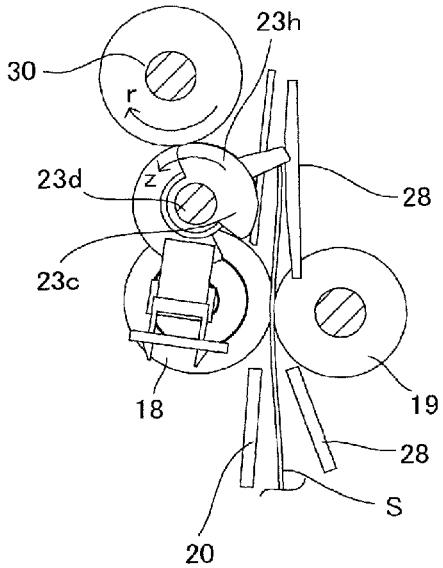
FIG. 7B illustrates the assist cam and the rotation assist roller in a state illustrated in FIG. 7A.
Figure 7C:
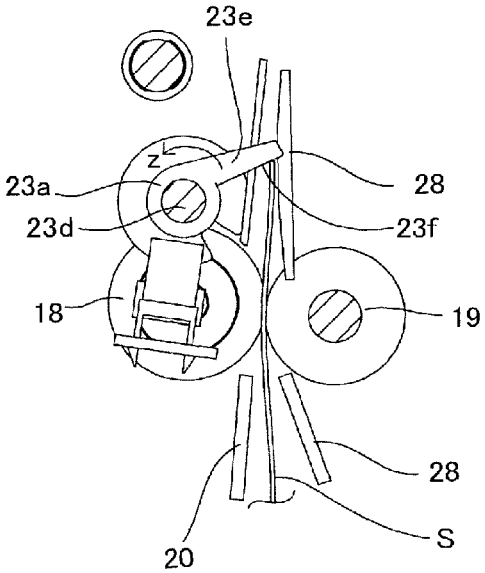
FIG. 7C illustrates the shutter flag in a state illustrated in FIG. 7A.
Figure 7D:
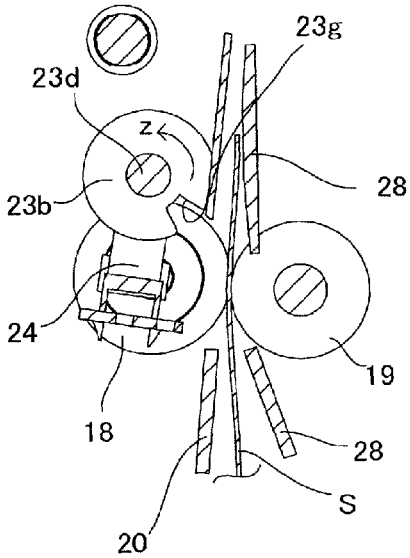
FIG. 7D illustrates the light shielding portion in a state illustrated in FIG. 7A.
Figure 8A:
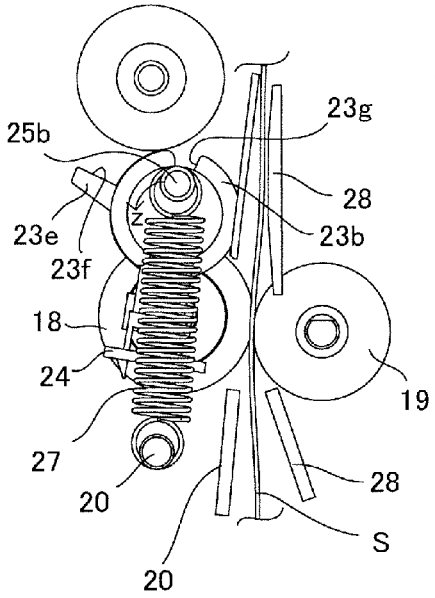
FIG. 8A illustrates a state in which the assist cam disengages from the rotation assist roller.
Figure 8B:
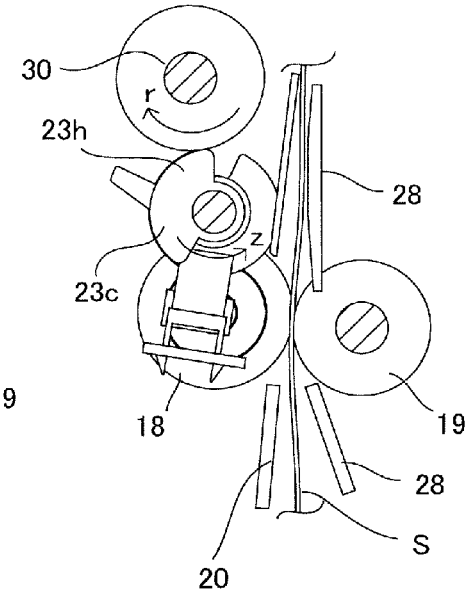
FIG. 8B illustrates the assist cam and the rotation assist roller in a state illustrated in FIG. 8A.
Figure 8C:
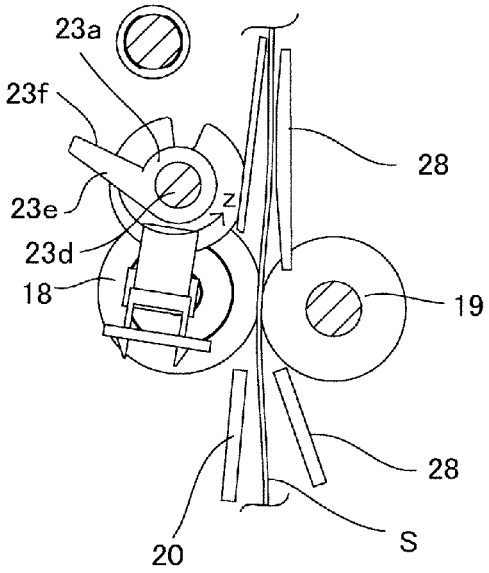
FIG. 8C illustrates the shutter flag in a state illustrated in FIG. 8A.
Figure 8D:
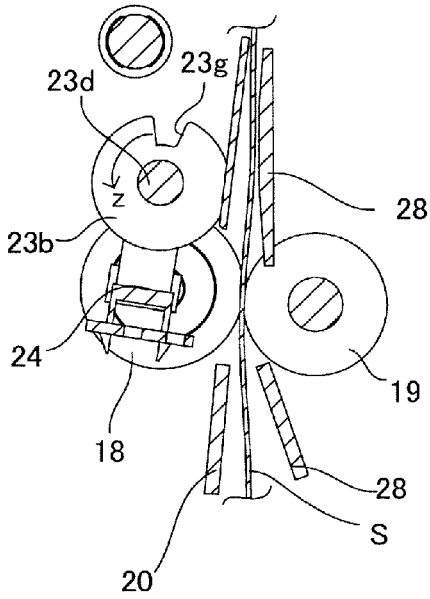
FIG. 8D illustrates the light shielding portion in a state illustrated in FIG. 8A.

FIG. 7A illustrates a state in which the assist cam 23*c* engages with the rotation assist roller 30. FIG. 7B illustrates the assist cam 23*c* and the rotation assist roller 30 in a state illustrated in FIG. 7A. FIG. 7C illustrates the shutter flag 23*a* in a state illustrated in FIG. 7A. FIG. 7D illustrates the light shielding portion 23*b* in a state illustrated in FIG. 7A. FIG. 8A illustrates a state in which the assist cam 23*c* is disengaged from the rotation assist roller 30. FIG. 8B illustrates the assist cam 23*c* and the rotation assist roller 30 in a state illustrated in FIG. 8A. FIG. 8C illustrates the shutter flag 23*a* in a state illustrated in FIG. 8A. FIG. 8D illustrates the light shielding portion 23*b* in a state illustrated in FIG. 8A.

Figure 9A:
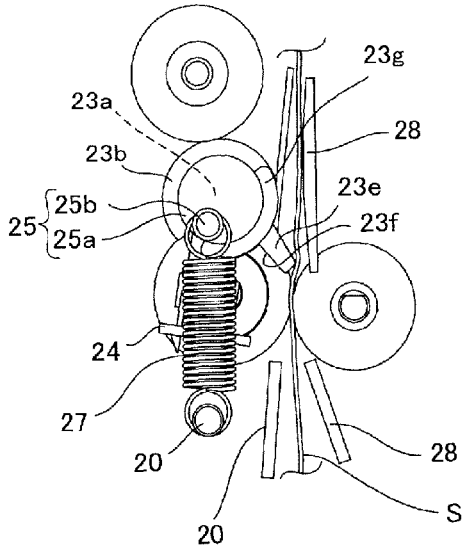
FIG. 9A illustrates a state in which the abutting portion of the shutter flag abuts against the sheet and enters a wait state.
Figure 9B:
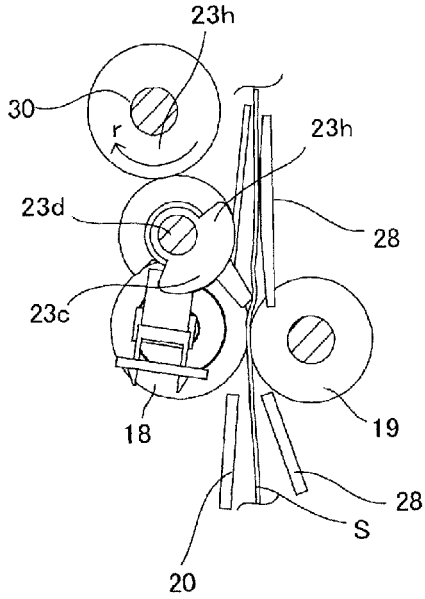
FIG. 9B illustrates the assist cam and the rotation assist roller in a state illustrated in FIG. 9A.
Figure 9C:
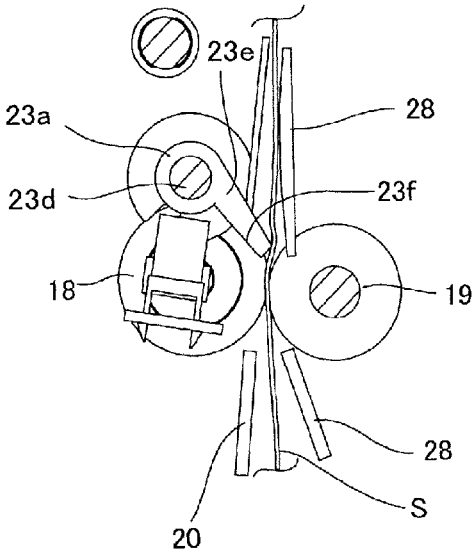
FIG. 9C illustrates the shutter flag in a state illustrated in FIG. 9A.
Figure 9D:
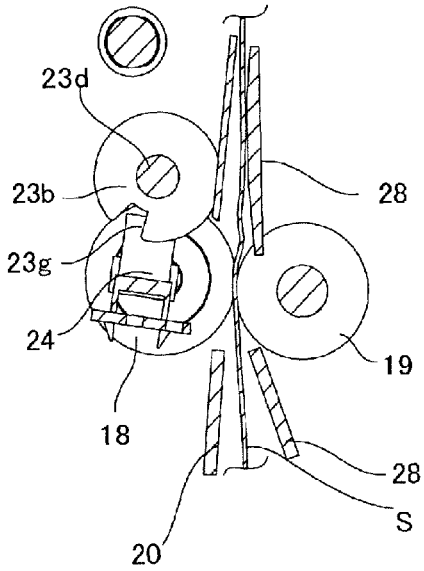
FIG. 9D illustrates the light shielding portion in a state illustrated in FIG. 9A.
Figure 10A:
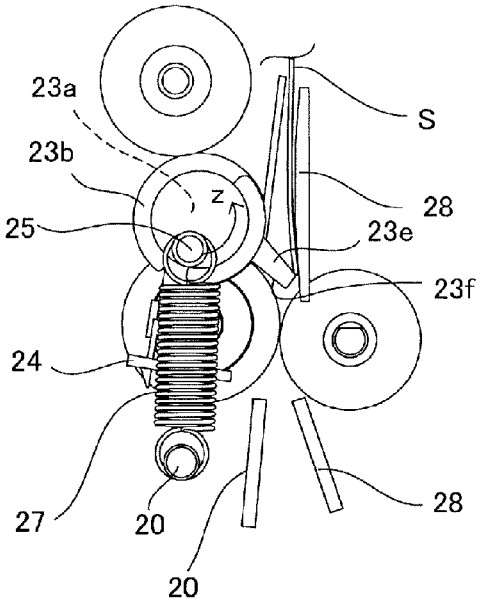
FIG. 10A illustrates a state in which the trailing end of the sheet passes through the shutter flag.
Figure 10B:
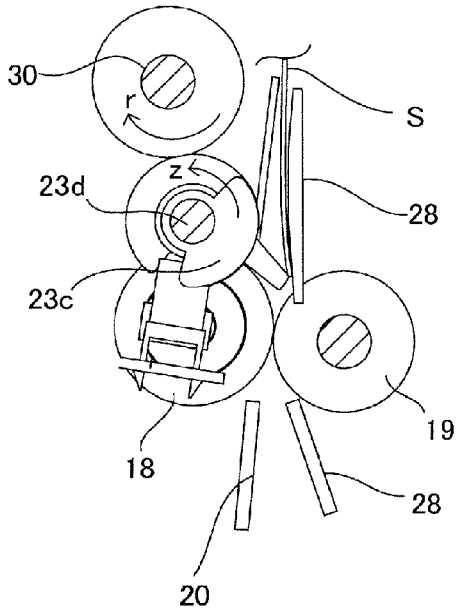
FIG. 10B illustrates the assist cam and the rotation assist roller in a state illustrated in FIG. 10A.
Figure 10C:
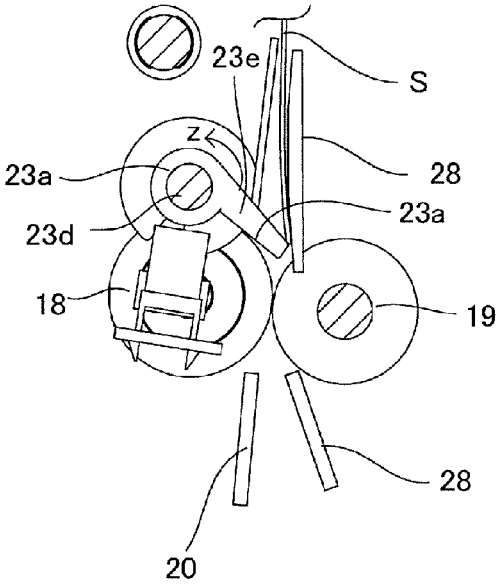
FIG. 10C illustrates the shutter flag in a state illustrated in FIG. 10A.
Figure 10D:
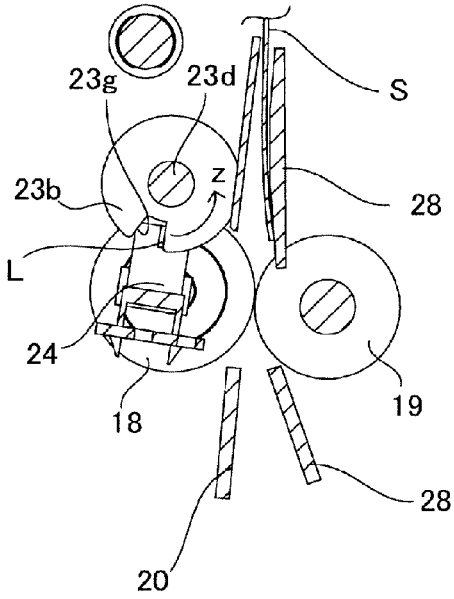
FIG. 10D illustrates the light shielding portion in a state illustrated in FIG. 10A.

FIG. 9A illustrates a state in which the abutting portion 23*e* of the shutter flag 23*a* abuts against the sheet S and enters a wait state. FIG. 9B illustrates the assist cam 23*c* and the rotation assist roller 30 in a state illustrated in FIG. 9A. FIG. 9C illustrates the shutter flag 23*a* in a state illustrated in FIG. 9A. FIG. 9D illustrates the light shielding portion 23*b* in a state illustrated in FIG. 9A. FIG. 10A illustrates a state in which the trailing end of the sheet S passes through the shutter flag 23*a*. FIG. 10B illustrates the assist cam 23*c* and the rotation assist roller 30 in a state illustrated in FIG. 10A. FIG. 10C illustrates the shutter flag 23*a* in a state illustrated in FIG. 10A. FIG. 10D illustrates the light shielding portion 23*b* in a state illustrated in FIG. 10A.

Figure 4B:
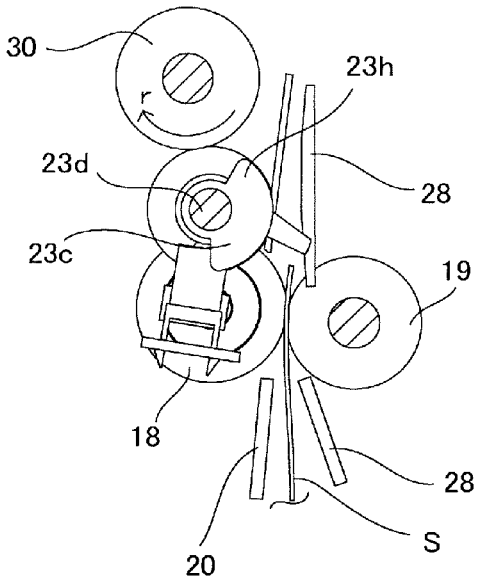
FIG. 4B illustrates an assist cam and a rotation assist roller in a state illustrated in FIG. 4A.
Figure 4C:
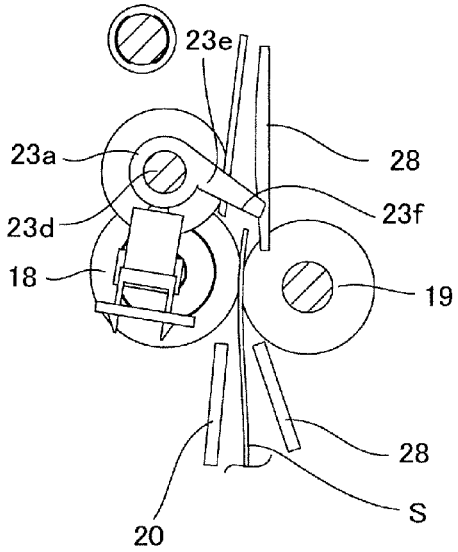
FIG. 4C illustrates an abutting portion of a shutter flag in a state illustrated in FIG. 4A.
Figure 4D:
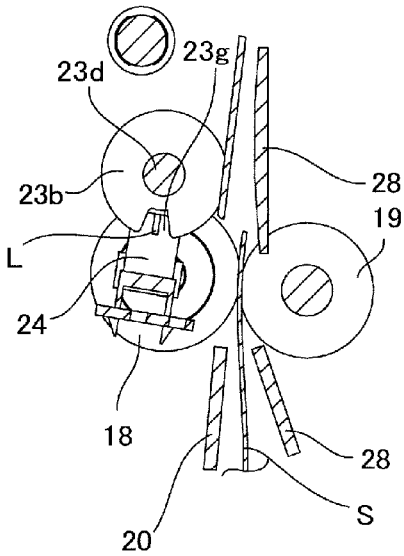
FIG. 4D illustrates a light shielding portion in a state illustrated in FIG. 4A.

As illustrated in FIGS. 4A and 4C, in the state in which the leading end of the sheet S does not abut against the abutment surface 23*f* of the shutter flag 23*a*, the biasing force of the shutter spring 27 causes the abutting portion 23*e* of the shutter flag 23*a* to be held in a wait state at the home position. As illustrated in FIG. 4B, at the home position, the assist cam 23*c* is spaced apart from the rotation assist roller 30, and the rotational driving force of the rotation assist roller 30 is not transmitted to the engaging portion 23*h* of the assist cam 23*c*. Further, as illustrated in FIG. 4D, the optical path L of the optical sensor 24 is allowed to pass through the slit portion 23*g* of the light shielding portion 23*b*.

Figure 5A:
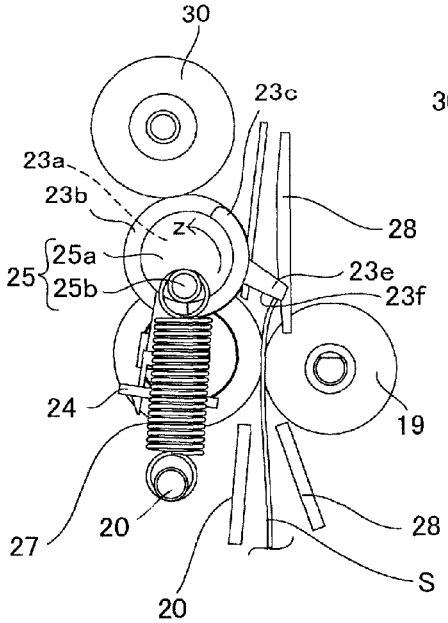
FIG. 5A illustrates a state in which a sheet abuts against the sensor flag.
Figure 5B:
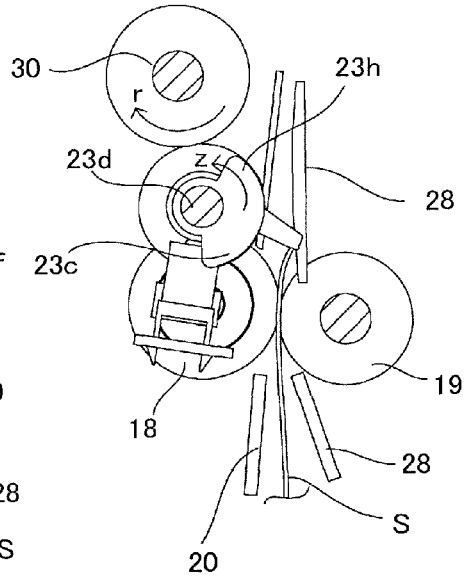
FIG. 5B illustrates an assist cam and a rotation assist roller in a state illustrated in FIG. 5A.
Figure 5C:
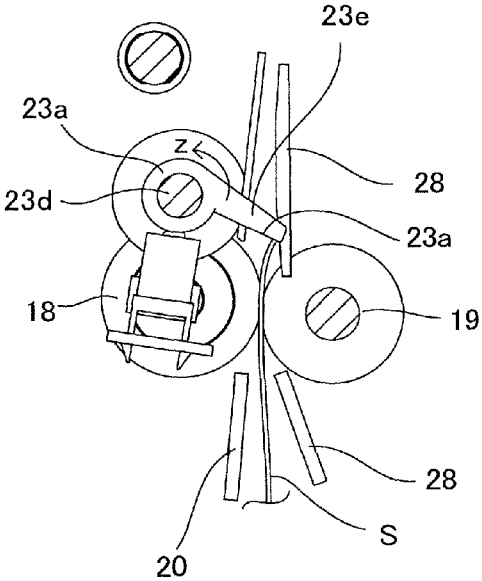
FIG. 5C illustrates the abutting portion of the shutter flag in a state illustrated in FIG. 5A.
Figure 5D:
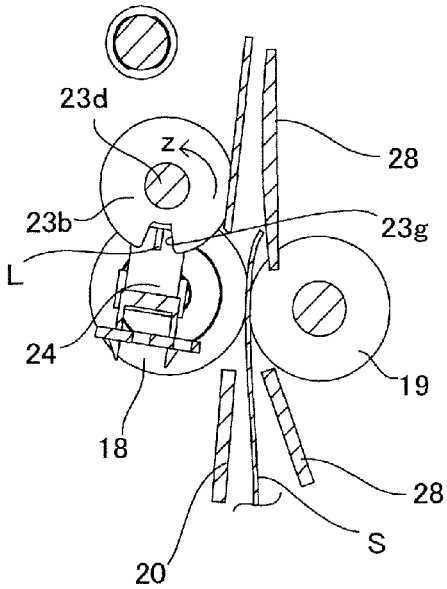
FIG. 5D illustrates the light shielding portion in a state illustrated in FIG. 5A.

As illustrated in FIG. 5A, the conveying force of the conveying roller pair 18, 19 causes the sheet S to be conveyed. When the abutment surface 23*f* of the shutter flag 23*a* is pushed by the leading end of the sheet S, the sheet S rotates the shutter flag 23*a* in a direction indicated by an arrow z as illustrated in FIG. 5A. At this time, the sheet S is conveyed against the holding force of the shutter driving portion 25 biased by the shutter spring 27. As illustrated in FIG. 5D, the leading end of the sheet S is guided by a paper feed guide including the paper feed frame 20 and the guide frame 28 and arranged downstream in the sheet conveying direction of the conveying roller pair 18, 19. Consequently, as illustrated in FIG. 5C, the paper feed guide can prevent the leading end of the sheet S from moving away from the abutment surface 23*f* and allows the leading end of the sheet S to surely push and rotate the shutter flag 23*a*. As illustrated in FIG. 5B, also in this state, the assist cam 23*c* is spaced apart from the rotation assist roller 30, and the rotational driving force of the rotation assist roller 30 is not transmitted to the engaging portion 23*h* of the assist cam 23*c*.

Figure 6A:
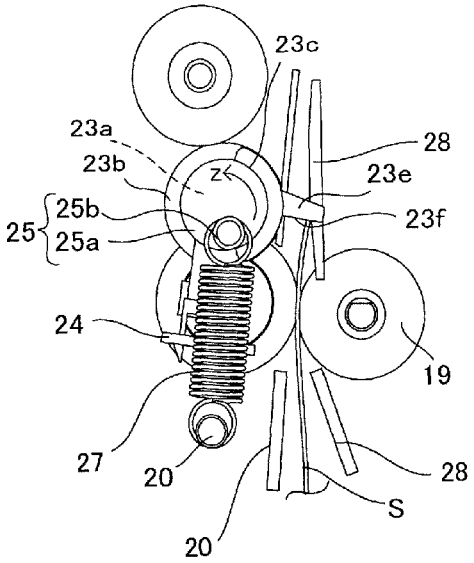
FIG. 6A illustrates a state in which the sensor flag rotates to shield an optical path of the optical sensor.
Figure 6B:
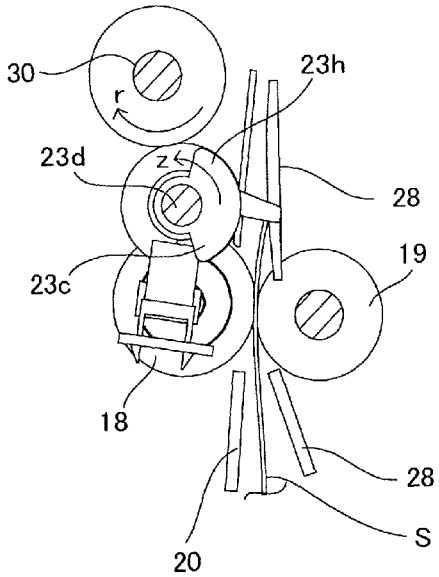
FIG. 6B illustrates the assist cam and the rotation assist roller in a state illustrated in FIG. 6A.
Figure 6C:
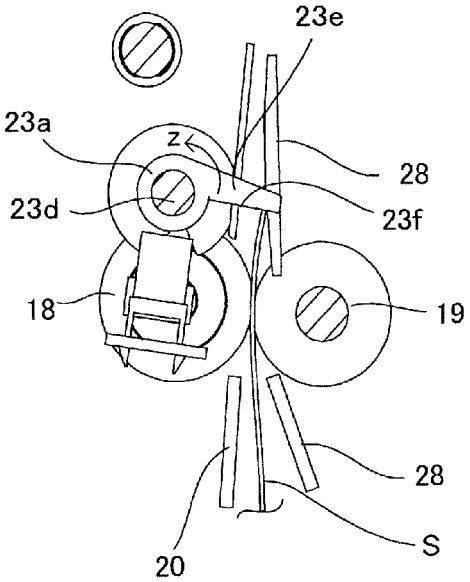
FIG. 6C illustrates the shutter flag in a state illustrated in FIG. 6A.
Figure 6D:
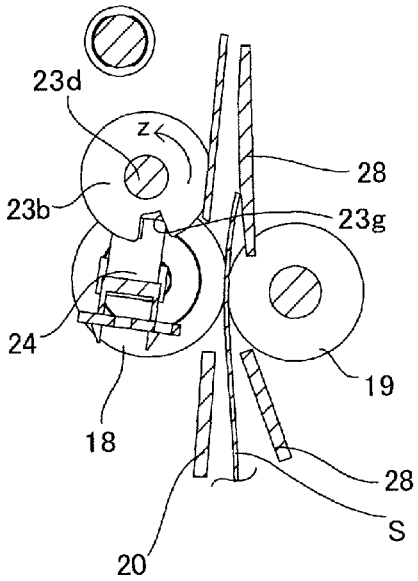
FIG. 6D illustrates the light shielding portion in a state illustrated in FIG. 6A.

As illustrated in FIGS. 6A and 6C, the abutment surface 23*f* is pushed by the leading end of the sheet S and the shutter flag 23*a* rotates against the biasing force of the shutter spring 27. Then, as illustrated in FIG. 6D, the optical path L of the optical sensor 24 is shielded by the light shielding portion 23*b*. When the optical path L of the optical sensor 24 is shielded, the sheet detection portion 22 detects that the shutter flag 23*a* rotates up to a predetermined rotational position and the leading end of the sheet S is conveyed up to a desired position. Then, the sheet detection portion 22 sends a predetermined signal to the image forming portion 14. When this signal is received, the image forming portion 14 starts to form a toner image. As illustrated in FIG. 6B, also in this state, the assist cam 23*c* is spaced apart from the rotation assist roller 30, and the rotational driving force of the rotation assist roller 30 is not transmitted to the engaging portion 23*h* of the assist cam 23*c*.

As illustrated in FIG. 7A, when the shutter flag further rotates, the engaging portion 23*h* of the assist cam 23*c* engages with the rotation assist roller 30 rotating in a direction indicated by an arrow r. As illustrated in FIG. 7B, when the engaging portion 23*h* of the assist cam 23*c* engages with the rotation assist roller 30, the rotational driving force of the rotation assist roller 30 is transmitted to the engaging portion 23*h* and the assist cam 23*c* rotates in a direction indicated by an arrow z, namely, in the same direction as the rotational direction of being pushed and rotated by the leading end of the sheet S. At a time when the engaging portion 23*h* engages with the rotation assist roller 30, the force for rotating the sensor flag 23 is switched from the conveying force of the sheet S to the rotational driving force of the rotation assist roller 30, the state of which continues up to the state in which the drive projection portion 25*b* of the shutter driving portion 25 exceeds the top dead center. The rotation of the assist cam 23*c* rotates the sensor flag 23 in the same direction (as the direction indicated by an arrow z), causing the abutting portion 23*e* (abutment surface 23*f*) of the shutter flag 23*a* to retract from the sheet S. As illustrated in FIGS. 7C and 7D, in this state, also the optical path L of the optical sensor 24 is shielded by the light shielding portion 23*b*.

As illustrated in FIG. 8A, the drive projection portion 25*b* of the shutter driving portion 25 reaches the top dead center. At substantially the same time, as illustrated in FIG. 8B, the engaging portion 23*h* of the assist cam 23*c* becomes spaced apart from the rotation assist roller 30. When the engaging portion 23*h* becomes spaced apart from the rotation assist roller 30, the subsequent rotation of the sensor flag 23 is performed by the biasing force of the shutter spring 27. As illustrated in FIGS. 8C and 8D, also in this state, the optical path L of the optical sensor 24 is shielded by the light shielding portion 23*b*.

The sensor flag 23 is rotated by the biasing force of the shutter spring 27 in a direction indicated by an arrow z as illustrated in FIG. 8A. Then, as illustrated in FIGS. 9A and 9B, the abutting portion 23*e* of the shutter flag 23*a* abuts against the surface of the sheet S conveyed by the conveying roller pair 18, 19. At this time, the biasing force of the shutter spring 27 biases the sensor flag 23 to return the sensor flag 23 to the standby position, but the sensor flag 23 cannot return to the standby position because the sheet S being conveyed is positioned on the rotation path. As illustrated in FIG. 9, the state (position) in which rotation is limited by abutting against the surface of the sheet S during passage is referred to as a sheet passing position of the sensor flag 23. As illustrated in FIG. 9D, also in this state, the optical path L of the optical sensor 24 is shielded by the light shielding portion 23*b*.

Along with a further conveyance of the sheet S and a passage of the trailing end of the sheet S through the shutter flag 23*a* (passing a position of contacting the abutting portion), as illustrated in FIGS. 10A to 10C, the shutter flag 23*a* rotates in a direction indicated by an arrow z by the biasing force of the shutter spring 27. When the shutter flag 23*a* rotates in a direction indicated by an arrow z, as illustrated in FIG. 10D, the light shielding portion 23*b* is released from shielding of the optical path L of the optical sensor 24. Then, the optical sensor 24 generates a transmission signal. Thus, the trailing end of the sheet S can be detected.

When the trailing end of the sheet S moves further away from the shutter flag 23*a* as illustrated in FIGS. 10A to 10D, the sensor flag 23 is rotated by a rotational force generated by the shutter spring 27 and the shutter driving portion 25. Then, the sensor flag 23 enters a wait state at the standby position for the abutment surface 23*f* of the shutter flag 23*a* to abut against the subsequent sheet S as illustrated in FIG. 4.

The image forming apparatus 100 according to the first embodiment having the above configuration can exert the following effects. The sheet detection portion 22 according to the first embodiment is configured such that the sensor flag 23 rotates in one direction and returns to the standby position by receiving a rotational driving force from the rotation assist roller 30, the assist cam 23*c*, and the shutter spring 27 constituting the rotation transmission portion. Specifically, the sensor flag 23 rotates to enter a wait state of being in contact with a sheet near the standby position. When the sheet S passes, the sensor flag 23 moves to the standby position. Consequently, the sensor flag can return to the standby position in a shorter time than the sensor flag takes to reciprocate. Thus, an increase in sheet gap distance can be prevented when increasing the conveying speed of the sheet S. More specifically, the sensor flag 23 can return to the standby position in a short sheet gap, which has been conventionally difficult under high sheet conveying speed conditions. As a result, throughput can be improved.

For example, the first embodiment can shorten the sheet gap to about half in comparison with a conventional sensor flag performing a reciprocating movement. Thus, the first embodiment can meet user demands to further improve throughput of the image forming apparatus. The assist cam 23*c* assists rotation to prevent a biasing force from being applied to the leading end of the sheet after skew correction, thus preventing damage such as scratching and folding from occurring in the leading end of the sheet.

According to the first embodiment, the assist cam 23*c* and the rotation assist roller 30 are used to transmit a rotational driving force to the sensor flag 23 and the biasing force of the shutter spring 27 is used to return the sensor flag 23 to the home position. Consequently, the rotational driving force can be transmitted to the sensor flag by a simple configuration. Thus, manufacturing costs can be suppressed or manufacturing at a low price is enabled.

<Second Embodiment>

Figure 11:
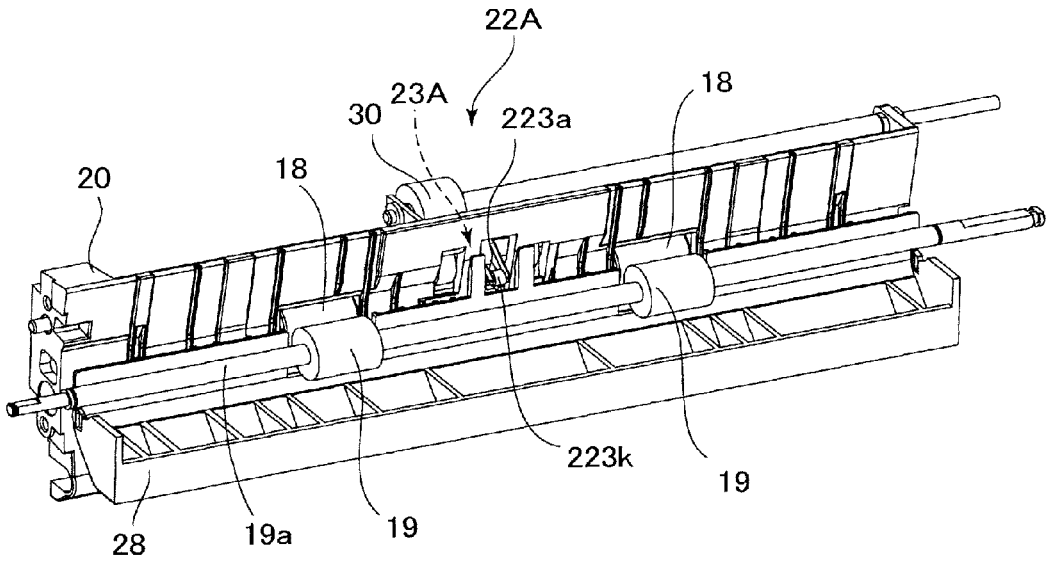
FIG. 11 is a perspective view illustrating a sheet detection portion supported by a paper feed frame according to a second embodiment.
Figure 12:
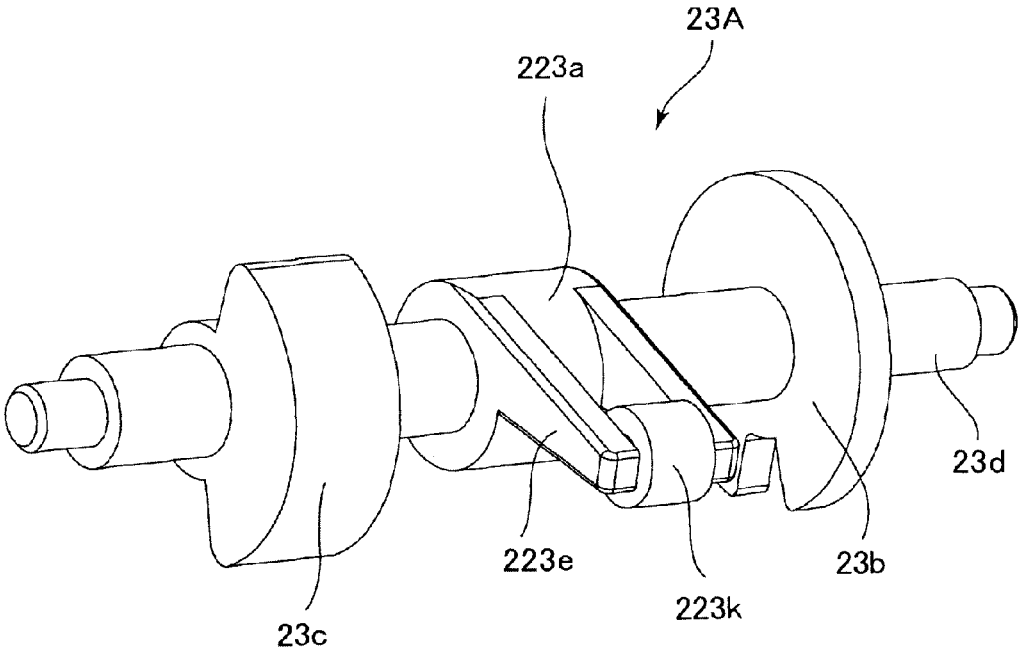
FIG. 12 is a perspective view illustrating a sensor flag of the sheet detection portion according to the second embodiment.
Figure 13A:
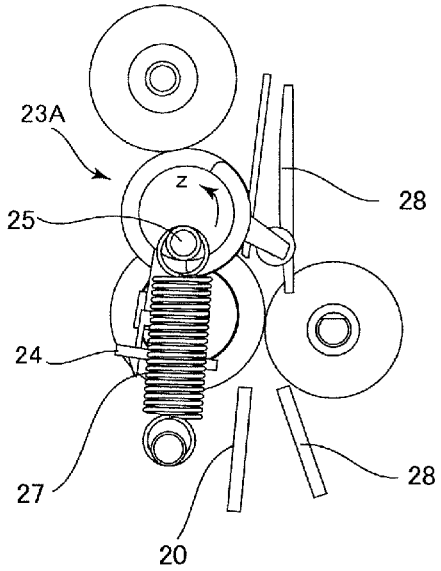
FIG. 13A illustrates the sheet detection portion according to the second embodiment.
Figure 13B:
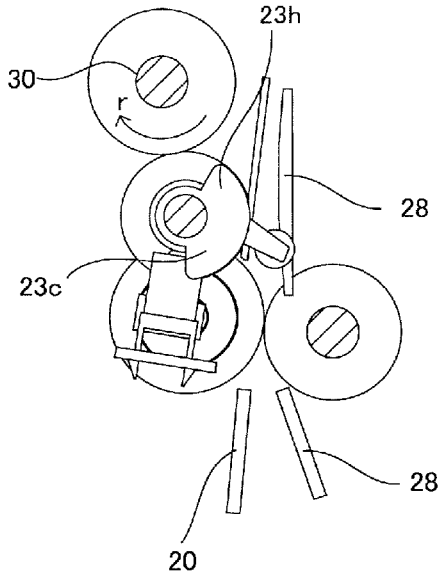
FIG. 13B illustrates an assist cam and a rotation assist roller in a state illustrated in FIG. 13A.
Figure 13C:
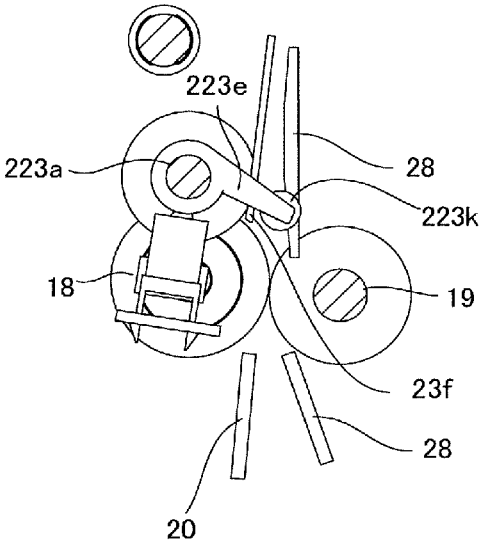
FIG. 13C illustrates an abutting portion of a shutter flag in a state illustrated in FIG. 13A.
Figure 13D:
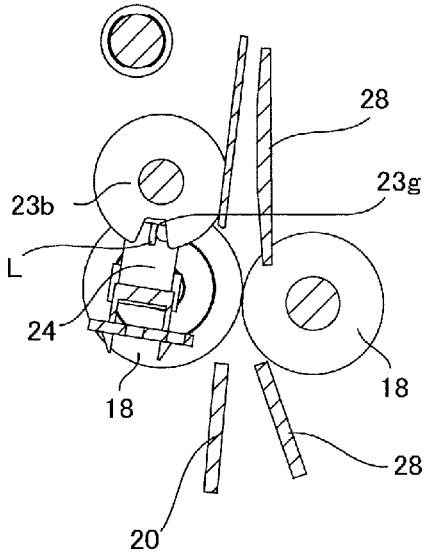
FIG. 13D illustrates a light shielding portion in a state illustrated in FIG. 13A.

An image forming apparatus 100A according to a second embodiment of the present invention will be described referring to FIGS. 11 to 14D. FIG. 11 is a perspective view illustrating a sheet detection portion 22A supported by a paper feed frame 20 according to the second embodiment. FIG. 12 is a perspective view illustrating a sensor flag 23A of the sheet detection portion 22A according to the second embodiment. FIG. 13A illustrates the sheet detection portion 22A according to the second embodiment. FIG. 13B illustrates an assist cam 23*c* and a rotation assist roller 30 in a state illustrated in FIG. 13A. FIG. 13C illustrates an abutting portion 223*e* of a shutter flag 223*a* in a state illustrated in FIG. 13A. FIG. 13D illustrates a light shielding portion 23*b* in a state illustrated in FIG. 13A.

Figure 14A:
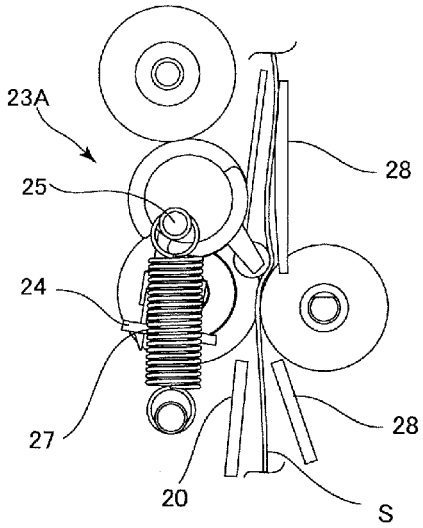
FIG. 14A illustrates a state in which the abutting portion of the shutter flag abuts against a sheet and enters a wait state.
Figure 14B:
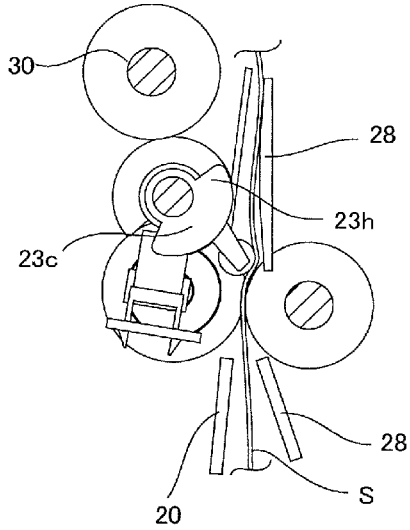
FIG. 14B illustrates the assist cam and the rotation assist roller in a state illustrated in FIG. 14A.
Figure 14C:
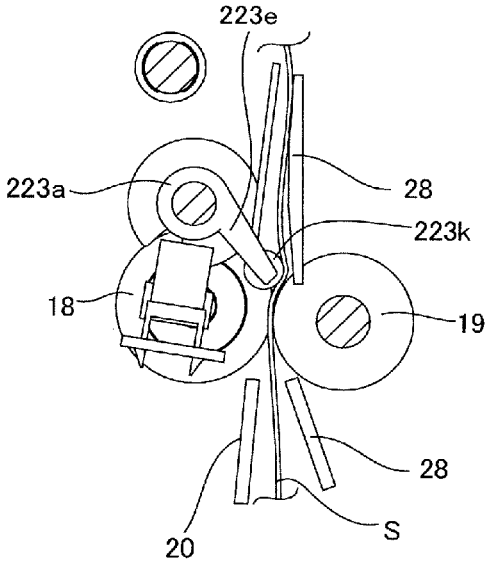
FIG. 14C illustrates the shutter flag in a state illustrated in FIG. 14A.
Figure 14D:
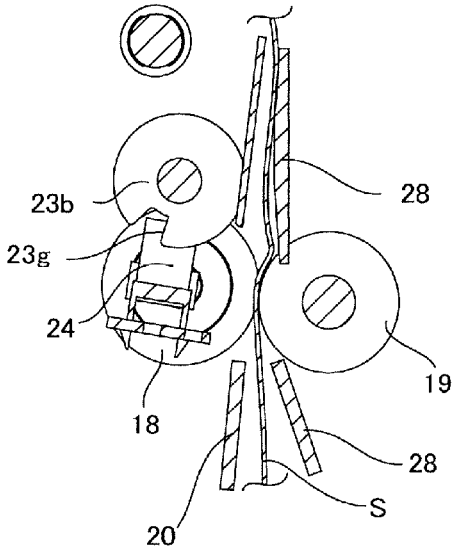
FIG. 14D illustrates the light shielding portion in a state illustrated in FIG. 14A.

FIG. 14A illustrates a state in which the abutting portion 223*e* of the shutter flag 223*a* abuts against a sheet S and enters a wait state. FIG. 14B illustrates the assist cam 23*c* and the rotation assist roller 30 in a state illustrated in FIG. 14A. FIG. 14C illustrates the shutter flag 223*a* in a state illustrated in FIG. 14A. FIG. 14D illustrates the light shielding portion 23*b* in a state illustrated in FIG. 14A.

The second embodiment is different from the first embodiment in that the sheet detection portion 22A of the second embodiment has a flag rotary member 223*k* on a tip of an abutting portion 223*e* of a shutter flag 223*a*. Thus, the description of the second embodiment will focus on the difference from the first embodiment, namely, the flag rotary member 223*k* provided on the shutter flag 223*a*. In the second embodiment, the same reference numerals or characters are assigned to the same components as those of the image forming apparatus 100 according to the first embodiment and the description thereof is omitted. In the second embodiment, the same components as those of the first embodiment exert the same effects as those of the first embodiment.

Referring to FIG. 1, the entire structure of the image forming apparatus 100A according to the second embodiment will be described. As illustrated in FIGS. 1 and 11, the image forming apparatus 100A according to the second embodiment includes a sheet feeding portion 8, an image forming portion 14, a fixing portion 10, a sheet conveying portion 9A, and a sheet discharging portion 13.

The sheet conveying portion 9A includes a sheet conveying path 15*a*, a duplex conveying path 15*b*, an oblique feed roller pair 16, a U-turn roller pair 17, the paper feed frame 20, a guide frame 28, a conveying roller pair 18, 19, and the sheet detection portion 22A. The sheet detection portion 22A includes the sensor flag 23A, an optical sensor 24, a shutter driving portion 25, a shutter spring 27, and the rotation assist roller 30. As illustrated in FIG. 12, the sensor flag 23A includes the shutter flag 223*a*, the light shielding portion 23*b*, the assist cam 23*c*, and a flag rotating shaft 23*d*.

The shutter flag 223*a* includes the abutting portion 223*e*, and the flag rotary member 223*k* rotatably supported on the tip of the abutting portion 223*e*. The flag rotary member 223*k* is supported by the abutting portion 223*e* so as to rotate while abutting against the surface of the sheet S to be conveyed.

Referring to FIGS. 13A to 14D, the operation of the sheet detection portion 22A will be described. As illustrated in FIGS. 13A and 13C, in a state in which the leading end of the sheet S does not abut against an abutment surface 223*f* of the shutter flag 223*a*, the abutting portion 223*e* of the shutter flag 223*a* is held in a wait state at the home position by the biasing force of the shutter spring 27. As illustrated in FIG. 13B, at the home position, the assist cam 23*c* is spaced apart from the rotation assist roller 30, and the rotational driving force of the rotation assist roller 30 is not transmitted to the engaging portion 23*h* of the assist cam 23*c*. Further, as illustrated in FIG. 13D, an optical path L of the optical sensor 24 is allowed to pass through a slit portion 23*g* of the light shielding portion 23*b*.

When the sensor flag 23 rotates in a direction indicated by an arrow z by the biasing force of the shutter spring 27, as illustrated in FIGS. 14A and 14B, the flag rotary member 223*k* of the shutter flag 223*a* rolls on and contacts the surface of the sheet S conveyed by the conveying roller pair 18, 19. At this time, the biasing force of the shutter spring 27 biases the sensor flag 23A to return the sensor flag 23A to the home position, but the sensor flag 23A cannot return to the home position because the sheet S is conveyed. Accordingly, as illustrated in FIG. 14C, in a state in which the shutter flag 223*a* is biased by the shutter spring 27, the flag rotary member 223*k* rolls on and contacts the surface of the sheet S to enter a wait state. As illustrated in FIG. 14D, also in this state, the optical path L of the optical sensor 24 is shielded by the light shielding portion 23*b*.

The image forming apparatus 100A according to the second embodiment having the above configuration can exert not only the effects resulting from the same configuration as that of the first embodiment but also the following effects. The sheet detection portion 22A according to the second embodiment has the flag rotary member 223*k* on the tip of the abutting portion 223*e* of the shutter flag 223*a*. Consequently, even in a state in which the sensor flag 23 rotates and contacts the surface of the sheet S to enter a wait state, the flag rotary member 223*k* rolls on and contacts the sheet S, thus preventing the abutting portion 223*e* from contacting the sheet S in a scratching manner. Thus, a contact trace of the abutting portion 223*e* is unlikely to remain to the sheet S. For example, a larger effect can be expected in a case in which the conveying roller pair 18, 19 is arranged downstream of the fixing apparatus and the abutting portion 223*e* of the shutter flag 223*a* contacts a toner image surface after the toner image is fixed.

<Third Embodiment>

Figure 15:
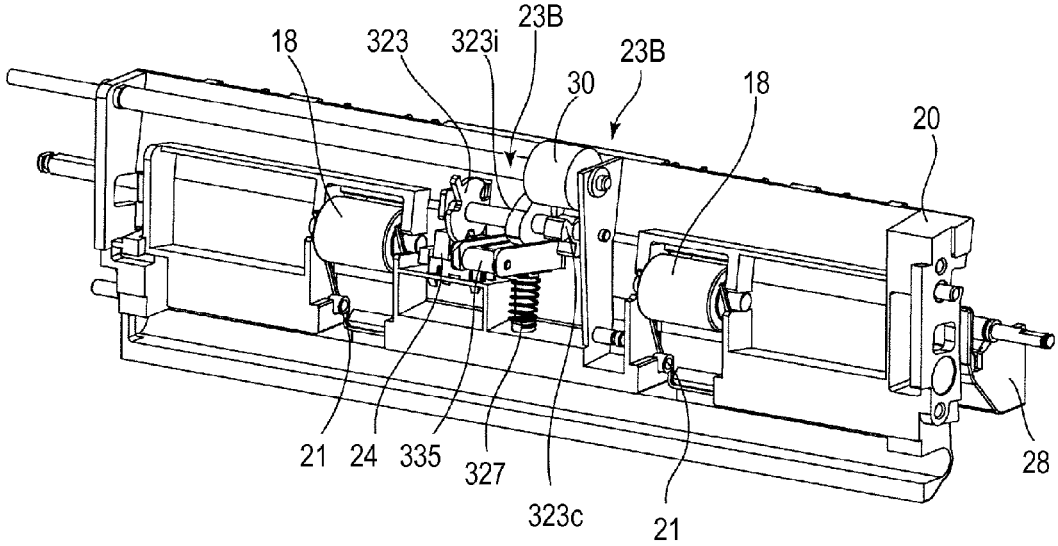
FIG. 15 is a perspective view illustrating a sheet detection portion supported by a paper feed frame according to a third embodiment.
Figure 16:
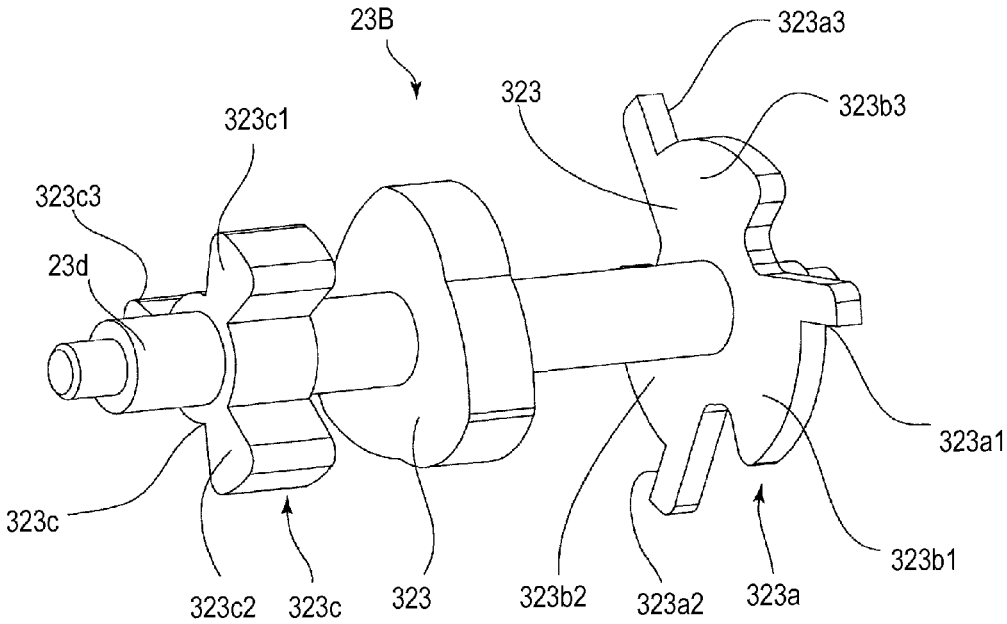
FIG. 16 is a perspective view illustrating a sensor flag of the sheet detection portion according to the third embodiment.
Figure 17A:
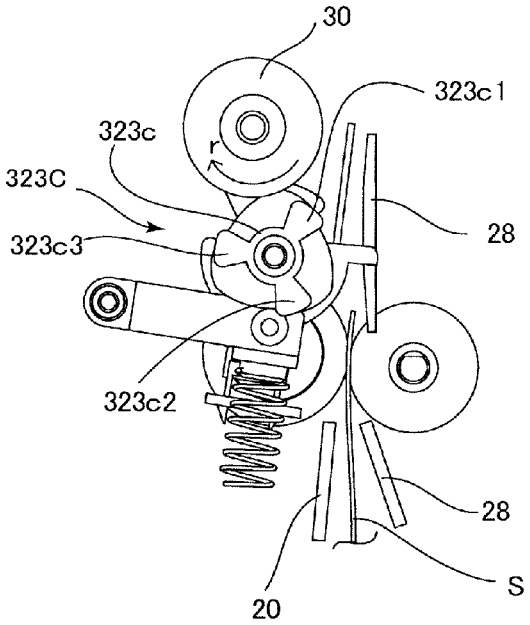
FIG. 17A illustrates the sheet detection portion according to the third embodiment.
Figure 17B:
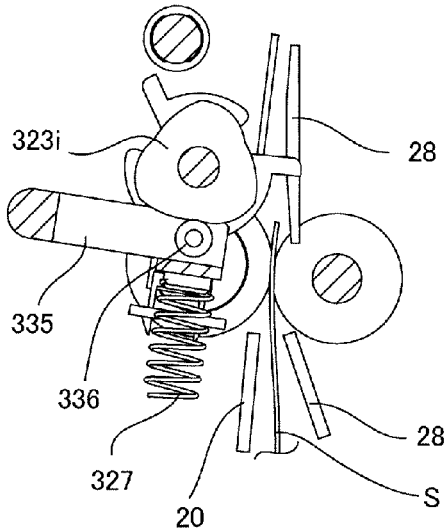
FIG. 17B illustrates a sensor cam, a shutter spring, a cam follower, and a pressing member in a state illustrated in FIG. 17A.
Figure 17C:
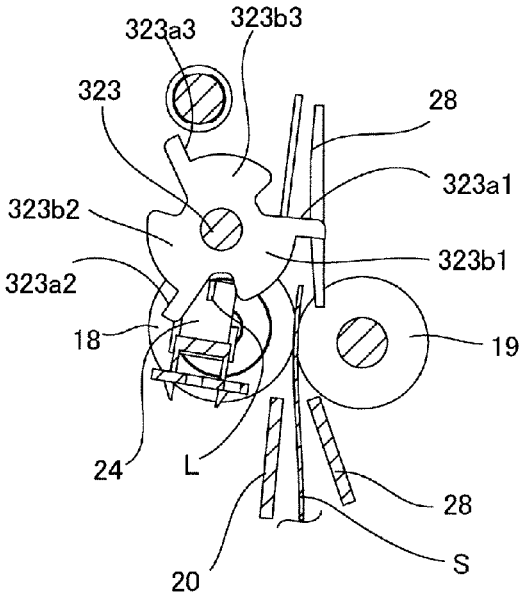
FIG. 17C illustrates an abutting portion and a light shielding portion of a shutter flag in a state illustrated in FIG. 17A.
Figure 18A:
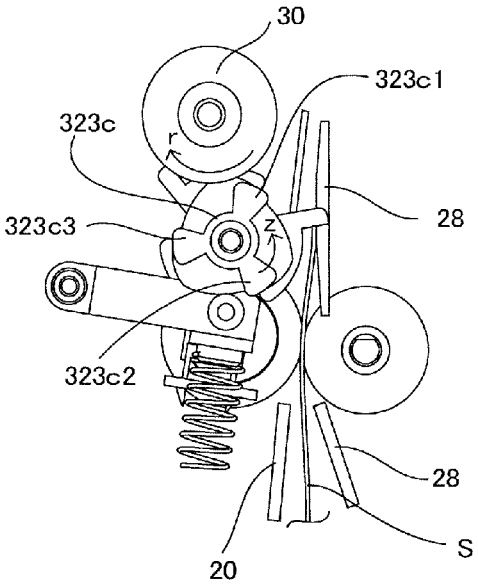
FIG. 18A illustrates a state in which the sensor flag rotates to shield an optical path of an optical sensor.
Figure 18B:
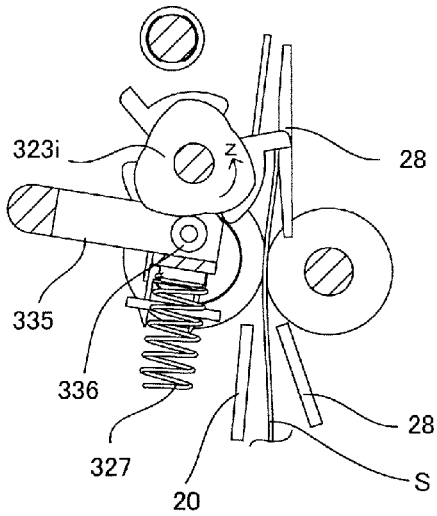
FIG. 18B illustrates the sensor cam, the shutter spring, the cam follower, and the pressing member in a state illustrated in FIG. 18A.
Figure 18C:
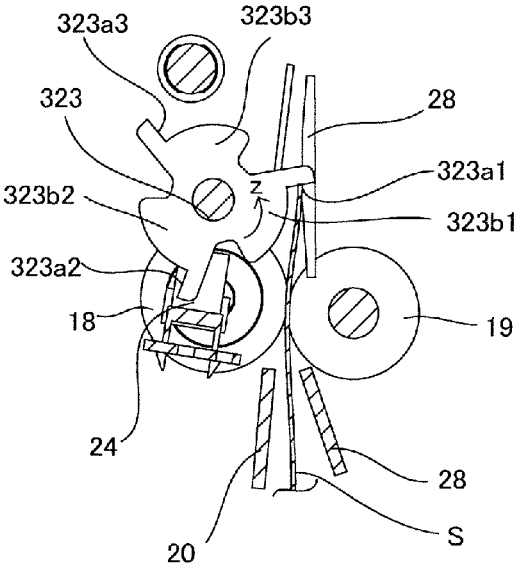
FIG. 18C illustrates the abutting portion and the light shielding portion of the shutter flag in a state illustrated in FIG. 18A.

Referring to FIG. 1 and further referring to FIGS. 15 to 22C, an image forming apparatus 100B according to the third embodiment of the present invention will be described. FIG. 15 is a perspective view illustrating a sheet detection portion 22B supported by a paper feed frame 20 according to the third embodiment. FIG. 16 is a perspective view illustrating a sensor flag 23B of the sheet detection portion 22B according to the third embodiment. FIG. 17A illustrates the sheet detection portion 22B according to the third embodiment. FIG. 17B illustrates a sensor cam 323*i*, a shutter spring 327, a cam follower 336, and a pressing member 335 in a state illustrated in FIG. 17A. FIG. 17C illustrates an abutting portion 323*a* and a light shielding portion 323*b* of a shutter flag 323 in a state illustrated in FIG. 17A. FIG. 18A illustrates a state in which the sensor flag 23B rotates to shield an optical path of an optical sensor. FIG. 18B illustrates the sensor cam 323*i*, the shutter spring 327, the cam follower 336, and the pressing member in a state illustrated in FIG. 18A. FIG. 18C illustrates the abutting portion 323*a* of the shutter flag 323 and the light shielding portion 323*b* in a state illustrated in FIG. 18A.

Figure 19A:
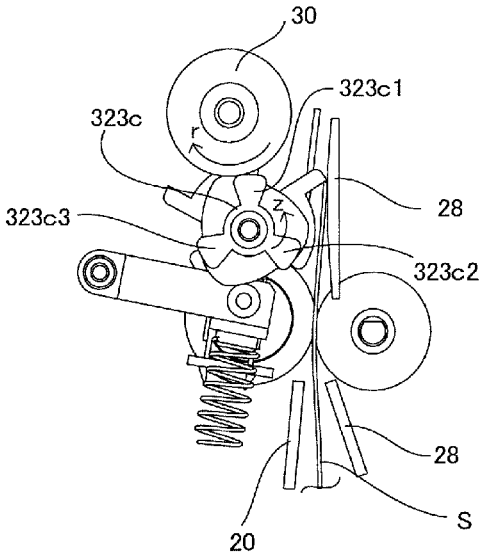
FIG. 19A illustrates a state in which the sensor cam engages with a rotation assist roller.
Figure 19B:
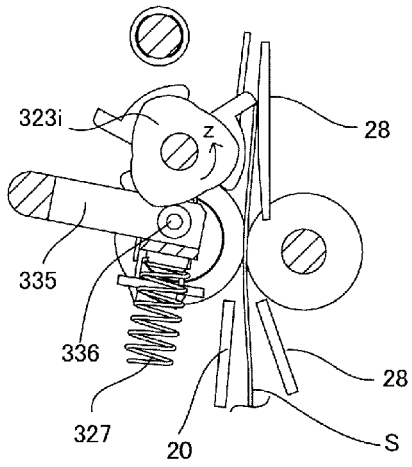
FIG. 19B illustrates the sensor cam, the shutter spring, the cam follower, and the pressing member in a state illustrated in FIG. 19A.

FIG. 19A illustrates a state in which the sensor cam 323*i* engages with a rotation assist roller 30. FIG. 19B illustrates the sensor cam 323*i*, the shutter spring 327, the cam follower 336, and the pressing member 335 in a state illustrated in FIG.

Figure 19C:
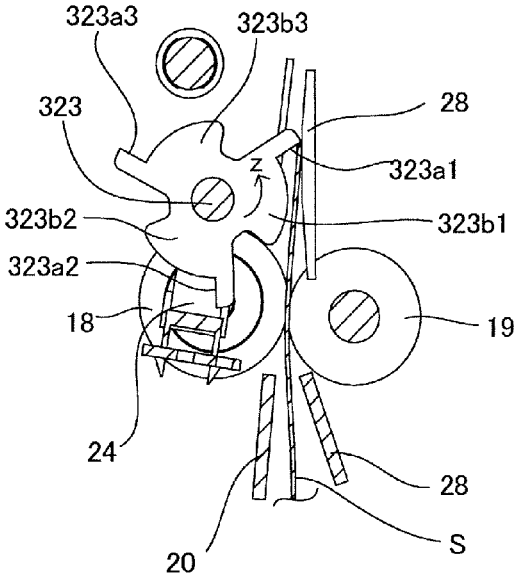
FIG. 19C illustrates the abutting portion and the light shielding portion of the shutter flag in a state illustrated in FIG. 19A.
Figure 20A:
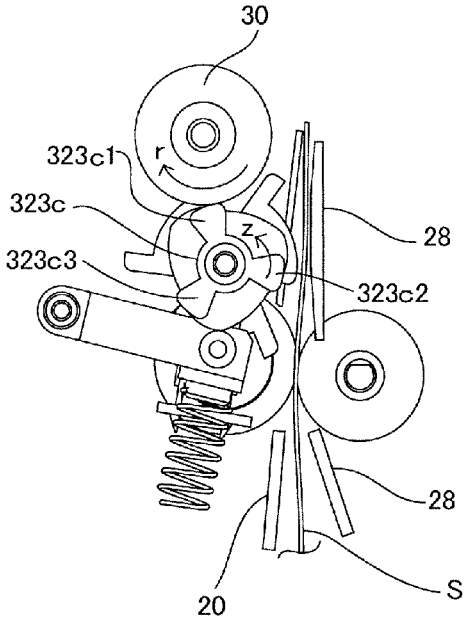
FIG. 20A illustrates a state in which the sensor cam disengages from the rotation assist roller.
Figure 20B:
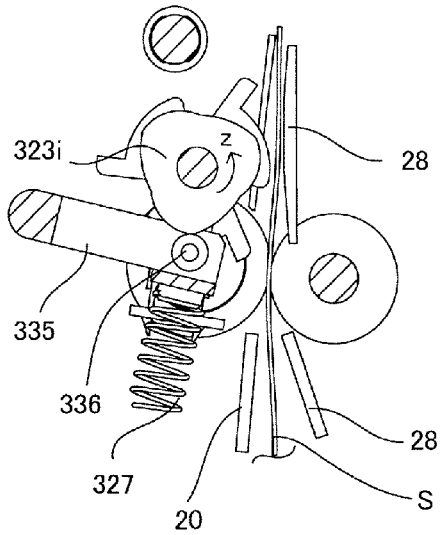
FIG. 20B illustrates the sensor cam, the shutter spring, the cam follower, and the pressing member in a state illustrated in FIG. 20A.
Figure 20C:
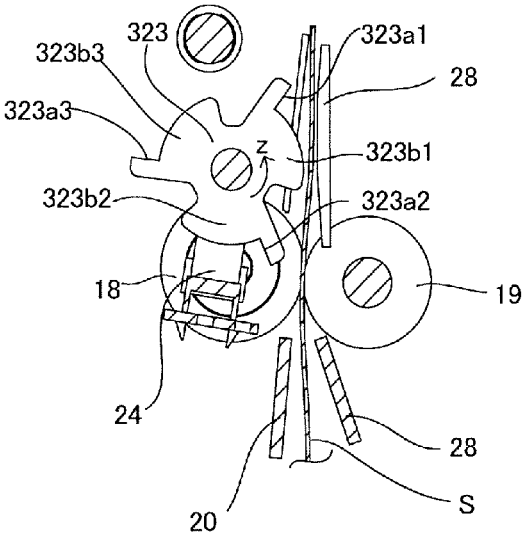
FIG. 20C illustrates the abutting portion and the light shielding portion of the shutter flag in a state illustrated in FIG. 20A.

19A. FIG. 19C illustrates the abutting portion 323*a* and the light shielding portion 323*b* of the shutter flag 323 in a state illustrated in FIG. 19A. FIG. 20A illustrates a state in which the sensor cam 323*i* disengages from the rotation assist roller 30. FIG. 20B illustrates the sensor cam, the shutter spring 327, the cam follower 336, and the pressing member 335 in a state illustrated in FIG. 20A. FIG. 20C illustrates the abutting portion 323*a* and the light shielding portion 323*b* of the shutter flag 323 in a state illustrated in FIG. 20A.

Figure 21A:
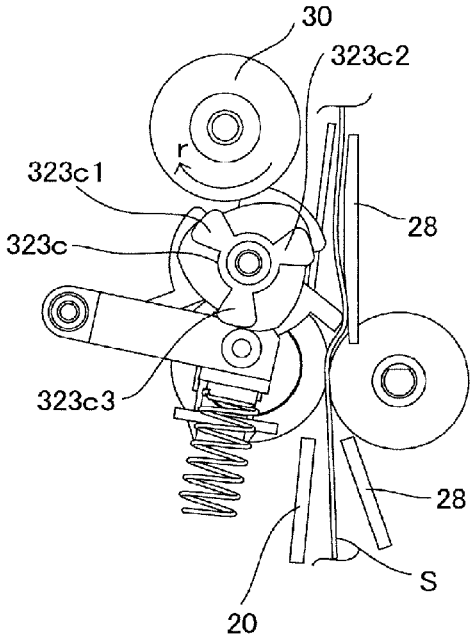
FIG. 21A illustrates a state in which the abutting portion of the shutter flag abuts against a sheet and enters a wait state.
Figure 21B:
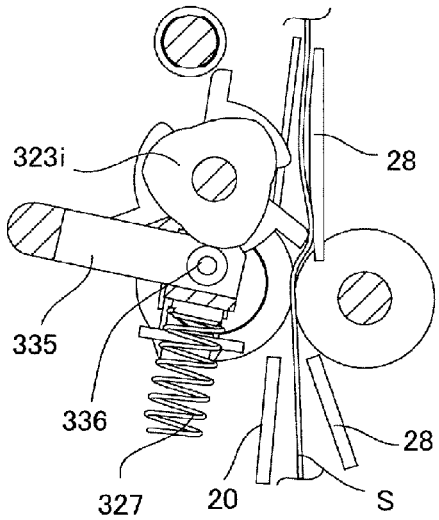
FIG. 21B illustrates the sensor cam, the shutter spring, the cam follower, and the pressing member in a state illustrated in FIG. 21A.
Figure 21C:
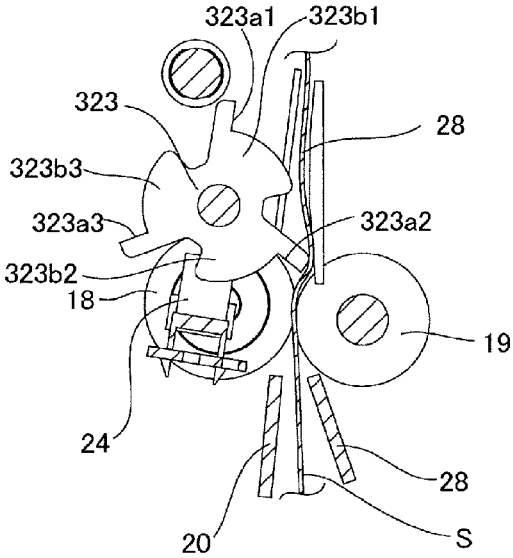
FIG. 21C illustrates the abutting portion and the light shielding portion of the shutter flag in a state illustrated in FIG. 21A.
Figure 22A:
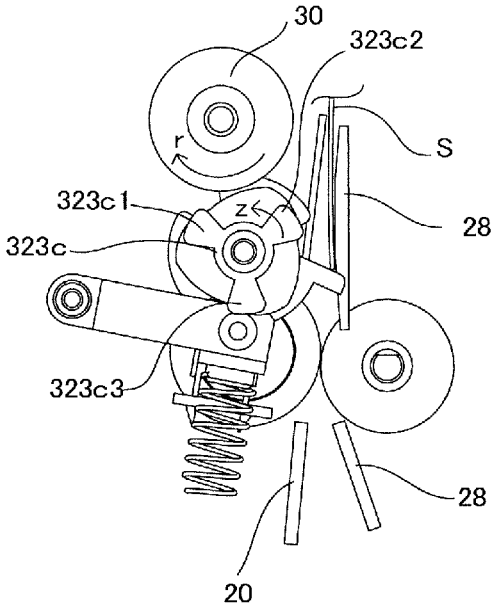
FIG. 22A illustrates a state in which the trailing end of the sheet passes through the shutter flag.
Figure 22B:
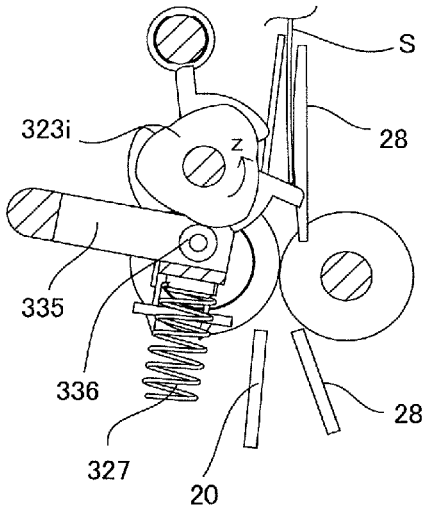
FIG. 22B illustrates the sensor cam, the shutter spring, the cam follower, and the pressing member in a state illustrated in FIG. 22A.
Figure 22C:
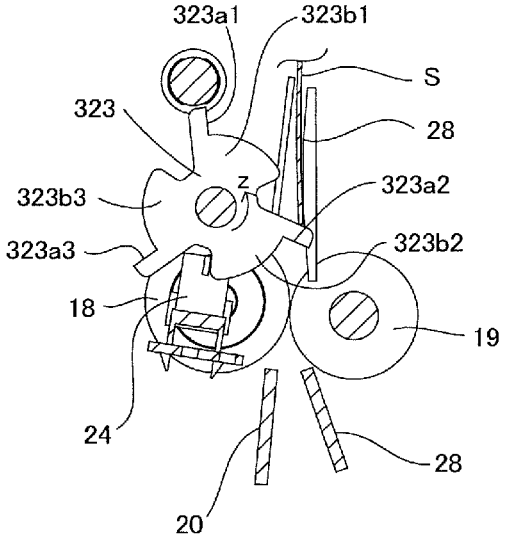
FIG. 22C illustrates the abutting portion and the light shielding portion of the shutter flag in a state illustrated in FIG. 22A.

FIG. 21A illustrates a state in which the abutting portion 323*a* of the shutter flag 323 abuts against the sheet and enters a wait state. FIG. 21B illustrates the sensor cam 323*i*, the shutter spring 327, the cam follower 336, and the pressing member 335 in a state illustrated in FIG. 21A. FIG. 21C illustrates the abutting portion 323*a* and the light shielding portion 323*b* of the shutter flag 323 in a state illustrated in FIG. 21A. FIG. 22A illustrates a state in which the trailing end of a sheet S passes through the shutter flag 323. FIG. 22B illustrates the sensor cam 323*i*, the shutter spring 327, the cam follower 336, and the pressing member 335 in a state illustrated in FIG. 22A. FIG. 22C illustrates the abutting portion 323*a* and the light shielding portion 323*b* of the shutter flag 323 in a state illustrated in FIG. 22A.

The third embodiment is different from the first embodiment in that the image forming apparatus 100B according to the third embodiment provides the sensor cam 323*i*, the shutter spring 327, the pressing member 335, and the cam follower 336 to exert a biasing force to bias the shutter flag 223. Further, the third embodiment is different from the first embodiment in the shape of the sensor flag 23B. Thus, the description of the third embodiment will focus on the differences from the first embodiment. In the third embodiment, the same reference numerals or characters are assigned to the same components as those of the image forming apparatus 100 according to the first embodiment and the description thereof is omitted. That is, in the third embodiment, the same components as those of the first embodiment exert the same effects as those of the first embodiment.

Referring to FIG. 1, the entire structure of the image forming apparatus 100B according to the third embodiment will be described. As illustrated in FIGS. 1 and 15, the image forming apparatus 100B according to the third embodiment includes a sheet feeding portion 8, an image forming portion 14, a fixing portion 10, a sheet conveying portion 9B, and a sheet discharging portion 13.

The sheet conveying portion 9B includes a sheet conveying path 15*a*, a duplex conveying path 15*b*, an oblique feed roller pair 16, a U-turn roller pair 17, the paper feed frame 20, a guide frame 28, a conveying roller pair 18, 19, and the sheet detection portion 22B. The sheet detection portion 22B includes the sensor flag 23B, an optical sensor 24, the shutter spring 327, the pressing member 335, the cam follower 336, and the rotation assist roller 30. As illustrated in FIG. 16, the sensor flag 23B includes the shutter flag 323, the light shielding portion 323*b*, an assist cam 323*c*, the sensor cam 323*i*, and a flag rotating shaft 23*d*.

The shutter flag 323 includes the abutting portion 323*a* and the light shielding portion 323*b*. The abutting portion 323*a* includes an abutting portion 323*a*1, an abutting portion 323*a*2, and an abutting portion 323*a*3. The light shielding portion 323*b* includes a light shielding portion 323*b*1, a light shielding portion 323*b*2, and a light shielding portion 323*b*3. The assist cam 323*c* includes an engaging portion 323*c*1, an engaging portion 323*c*2, and an engaging portion 323*c*3 to engage with the rotation assist roller 30. The sensor cam 323*i* is fixed to the flag rotating shaft 23*d* and rotates integrally with the flag rotating shaft 23*d*. The sensor cam 323*i* uses the shutter spring 327, the cam follower 336, and the pressing member 335 to exert a biasing force to bias the sensor flag 23B.

Referring to FIGS. 17A to 22C, the operation of the sheet detection portion 22B will be described. As illustrated in FIG. 17A, in a state in which the leading end of the sheet S does not abut against the abutting portion 323*a* of the shutter flag 323, the abutting portion 323*a* of the shutter flag 323 is held in a wait state at the home position by the biasing force of the shutter spring 27. At the home position, the assist cam 323*c* is spaced apart from the rotation assist roller 30, and the rotational driving force of the rotation assist roller 30 is not transmitted to any of the engaging portion 323*c*1, the engaging portion 323*c*2, and the engaging portion 323*c*3 of the assist cam 323*c*. As illustrated in FIG. 17C, an optical path L of the optical sensor 24 enters a state of not being shielded by any of the light shielding portion 323*b*1, the light shielding portion 323*b*2, and the light shielding portion 323*b*3 of the shutter flag 323.

As illustrated in FIGS. 18A and 18C, when the sheet S pushes the abutting portion 323*a*1 of the shutter flag 323 in a direction indicated by an arrow z and the shutter flag 323 rotates against the biasing force of the shutter spring 327, the optical path L is shielded by the light shielding portion 323*b*2. When the optical path L of the optical sensor 24 is shielded, the sheet detection portion 22B detects that the shutter flag 323 rotates up to a predetermined rotational position and the leading end of the sheet S is conveyed up to a desired position. Then, the sheet detection portion 22B sends a predetermined signal to the image forming portion 14. When this signal is received, the image forming portion 14 starts to form a toner image. As illustrated in FIG. 18A, also in this state, the assist cam 323*c* is spaced apart from the rotation assist roller 30, and the rotational driving force of the rotation assist roller 30 is not transmitted to the engaging portion 323*c*1 of the assist cam 323*c*.

As illustrated in FIG. 19A, the shutter flag 323 is further rotated by the leading end of the sheet S, the engaging portion 323*c*1 of the assist cam 323*c* engages with the rotation assist roller 30 rotating in a direction indicated by an arrow r. When the engaging portion 323*c*1 of the assist cam 323*c* engages with the rotation assist roller 30, the rotational driving force of the rotation assist roller 30 is transmitted to the engaging portion 323*c*1 and the assist cam 323*c* rotates in a direction indicated by an arrow z. At a time when the engaging portion 323*c*1 engages with the rotation assist roller 30, the force for rotating the sensor flag 23B is switched from the conveying force of the sheet S to the rotational driving force of the rotation assist roller 30. The rotation continues up to the state in which the sensor cam 323*i* exceeds the top dead center. The rotation of the assist cam 323*c* rotates the shutter flag 323 in the same direction (as the direction indicated by an arrow z), causing the abutting portion 323*a*1 of the shutter flag 323 to retract from the sheet S. As illustrated in FIG. 19C, also in this state, the optical path L of the optical sensor 24 is shielded by the light shielding portion 323*b*2. As illustrated in FIG. 19B, the sensor cam 323*i* also rotates in a direction indicated by an arrow z, and thus the sensor cam 323*i* assists in pushing down the cam follower 336, the pressing member 335, and the shutter spring 327.

As illustrated in FIGS. 20A and 20B, the sensor cam 323*i* reaches the top dead center. At substantially the same time, as illustrated in FIG. 20A, the engaging portion 323*c*1 of the assist cam 323*c* becomes spaced apart from the rotation assist roller 30. When the engaging portion 323*c*1 becomes spaced apart from the rotation assist roller 30, the biasing force of the cam follower 336, the pressing member 335, and the shutter spring 327 pushes up the sensor cam 323*i* to rotate the shutter flag 323. As illustrated in FIG. 20C, also in this state, the optical path L of the optical sensor 24 is shielded by the light shielding portion 323*b*2.

When the biasing force of the cam follower 336, the pressing member 335, and the shutter spring 327 pushes up the sensor cam 323*i*, the abutting portion 323*a*2 of the shutter flag 323 enters a state of contacting the surface of the sheet S as illustrated in FIGS. 21A to 21C. At this time, the biasing force of the shutter spring 327 and the like biases the abutting portion 323*a*2 of the shutter flag 323 to return to the home position, but the abutting portion 323*a*2 of the shutter flag 323 cannot return to the home position because the sheet S is conveyed. Accordingly, as illustrated in FIG. 21C, the abutting portion 323*a*2 of the shutter flag 323 enters a state of being biased by the shutter spring 327 and the like to abut against the surface of the sheet S in a wait state. As illustrated in FIG. 21C, also in this state, the optical path L of the optical sensor 24 is also shielded by the light shielding portion 323*b*2.

When the sheet S is further conveyed and the trailing end of the sheet S passes through the shutter flag 323, the shutter flag 323 rotates in a direction indicated by an arrow z as illustrated in FIGS. 22A to 22C. When the shutter flag 323 rotates in a direction indicated by an arrow z, the light shielding portion 323*b*2 is released from shielding of the optical path L of the optical sensor 24 as illustrated in FIG. 22C. Then, the optical sensor 24 generates a transmission signal. Thus, the trailing end of the sheet S can be detected.

When the trailing end of the sheet S moves away from the shutter flag 323 as illustrated in FIGS. 22A to 22C, the sensor flag 23B is rotated by a rotational force generated by the shutter spring 327, the sensor cam 323*i*, and the like. Then, the sensor flag 23B enters a wait state at the home position for the abutting portion 323*a*2 of the shutter flag 323 to abut against a leading end of the subsequent sheet S as illustrated in FIG. 17A.

The image forming apparatus 100B according to the third embodiment having the above configuration can exert not only the effects resulting from the same configuration as that of the first embodiment but also the following effects. The sheet detection portion 22B according to the third embodiment includes the shutter flag 323 having the abutting portions 323*a*1, 323*a*2 and 323*a*3, and the light shielding portions 323*b*1, 323*b*2 and 323*b*3; the assist cam 323*c* having the engaging portions 323*c*1, 323*c*2 and 323*c*3; and the sensor cam 323*i*. Accordingly, the sheet detection portion 22B can detect the leading end of the sheet S without a whole turn of the sensor flag 23B. Thus, it can take less time to position the abutting portion 323*a* at the home position, and an increase in sheet gap distance can be prevented when increasing the conveying speed of the sheet S. As a result, throughput can be improved.

According to the sheet detection portion 22B of the third embodiment, even the configuration of biasing the shutter flag 323 by using the shutter spring 327 and the assist cam 323*c* can assist the shutter flag 323 in giving the sensor cam 323*i* a force for rolling over the top dead center. Use of the assist cam 323*c* to assist the rotation can eliminate the need for the force for pushing the shutter flag 323 to depend only on stiffness of the sheet S, thus preventing damage such as scratching and folding from occurring in the leading end of the sheet S.

<Fourth Embodiment>

Figure 23A:
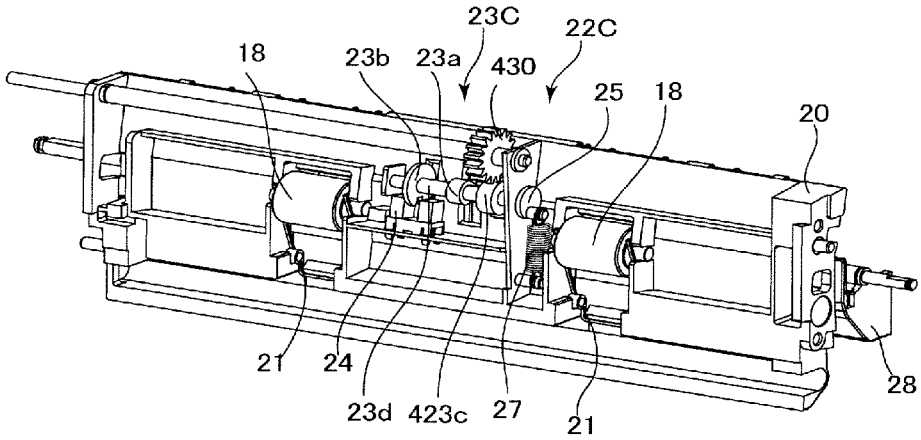
FIG. 23A is a perspective view illustrating a sheet detection portion supported by a paper feed frame according to a fourth embodiment.
Figure 23B:
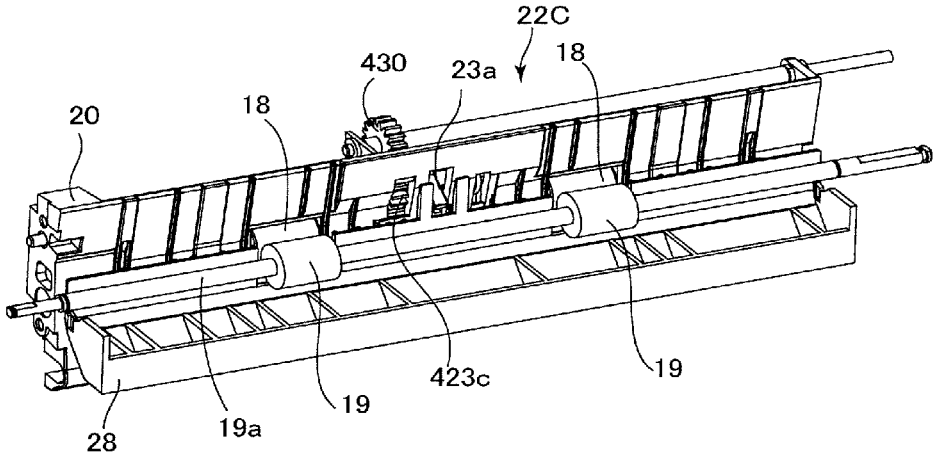
FIG. 23B is a perspective view illustrating the sheet detection portion viewed from an opposite side thereof illustrated in FIG. 23A.
Figure 24A:
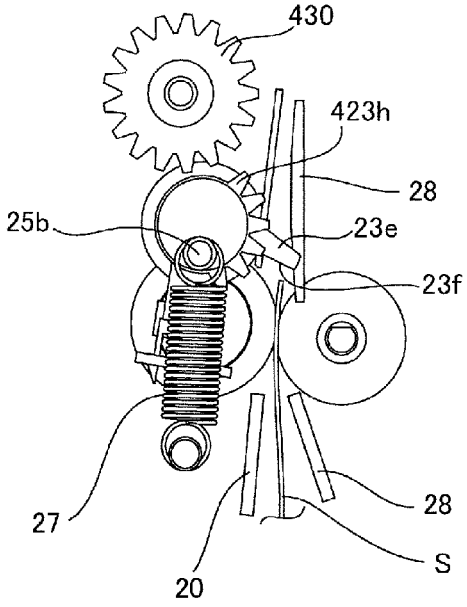
FIG. 24A illustrates the sheet detection portion according to the fourth embodiment.
Figure 24B:
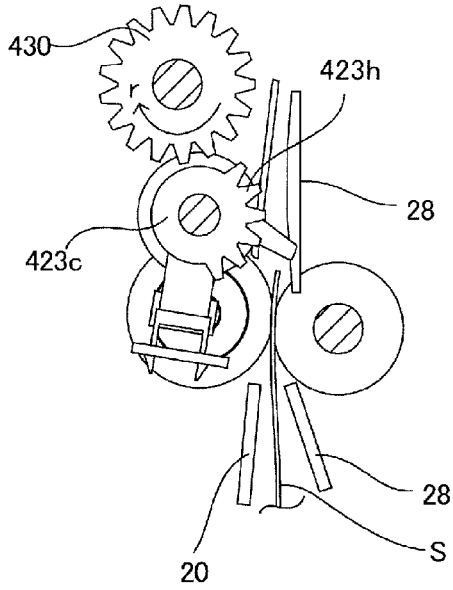
FIG. 24B illustrates an assist gear and a rotation assist gear in a state illustrated in FIG. 24A.
Figure 24C:
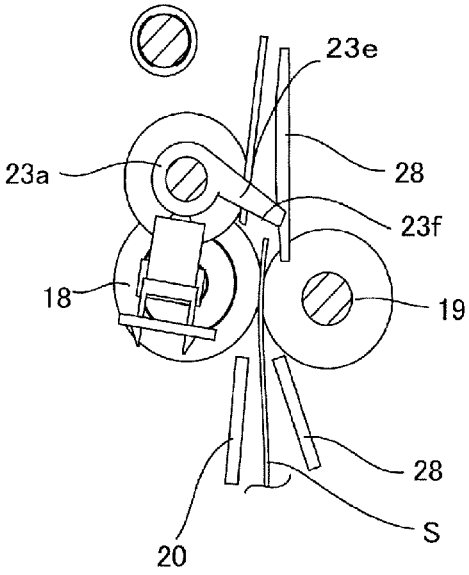
FIG. 24C illustrates an abutting portion of a shutter flag in a state illustrated in FIG. 24A.
Figure 24D:
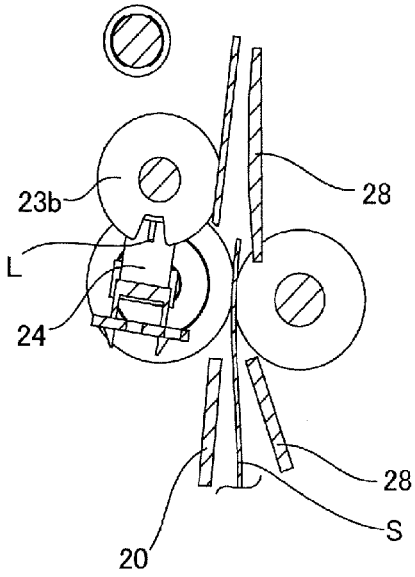
FIG. 24D illustrates a light shielding portion in a state illustrated in FIG. 24A.

Referring to FIG. 1 and further referring to FIGS. 23A to 26D, an image forming apparatus 100C according to a fourth embodiment of the present invention will be described. FIG. 23A is a perspective view illustrating a sheet detection portion 22C supported by a paper feed frame 20 according to the fourth embodiment. FIG. 23B is a perspective view illustrating the sheet detection portion 22C viewed from an opposite side thereof illustrated in FIG. 23A. FIG. 24A illustrates the sheet detection portion 22C according to the fourth embodiment. FIG. 24B illustrates an assist gear and a rotation assist gear in a state illustrated in FIG. 24A. FIG. 24C illustrates an abutting portion 23*e* of a shutter flag in a state illustrated in FIG. 24A. FIG. 24D illustrates a light shielding portion in a state illustrated in FIG. 24A.

Figure 25A:
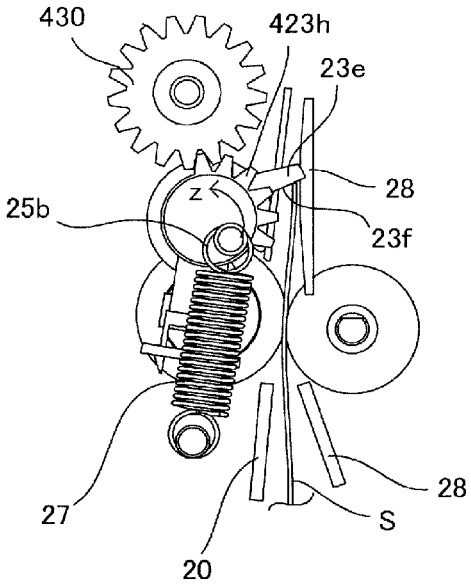
FIG. 25A illustrates a state in which the assist gear engages with the rotation assist gear.
Figure 25B:
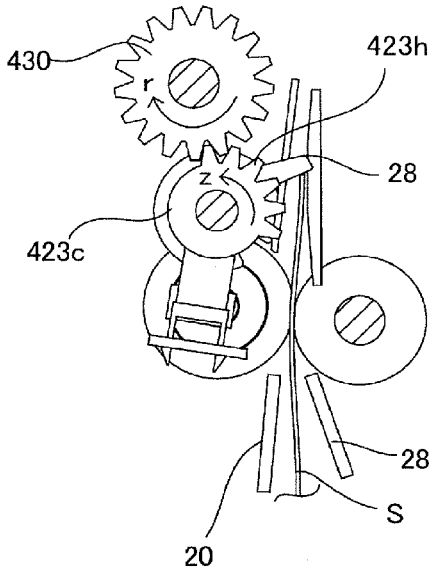
FIG. 25B illustrates the assist gear and the rotation assist gear in a state illustrated in FIG. 25A.
Figure 25C:
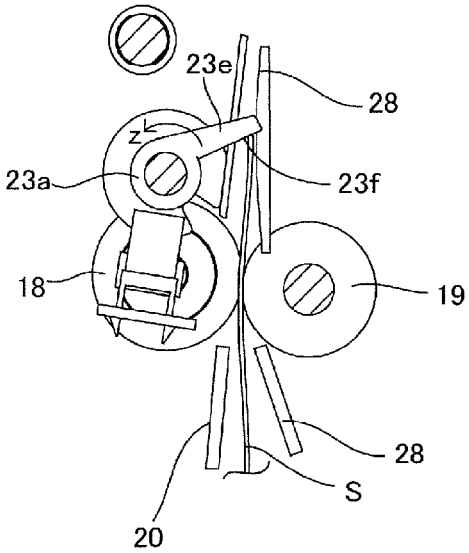
FIG. 25C illustrates the shutter flag in a state illustrated in FIG. 25A.
Figure 25D:
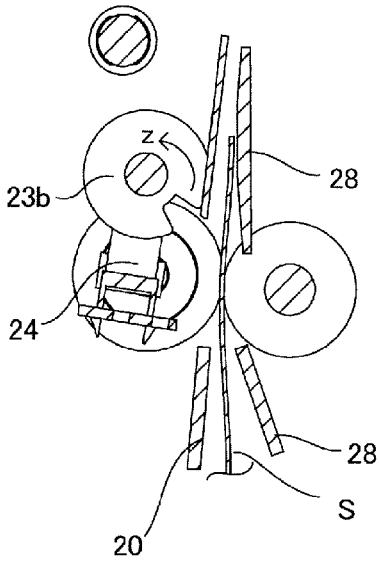
FIG. 25D illustrates the light shielding portion in a state illustrated in FIG. 25A.
Figure 26A:
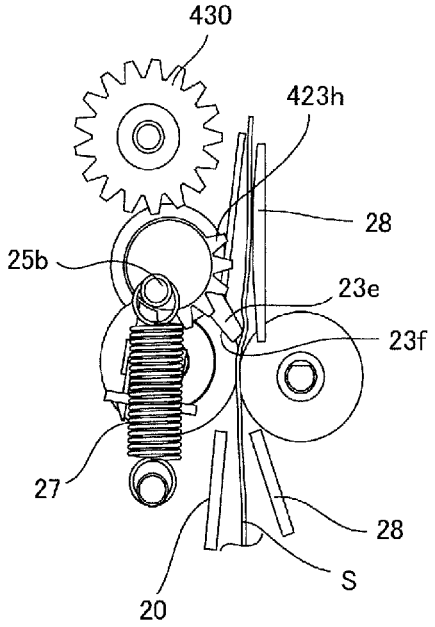
FIG. 26A illustrates a state in which the abutting portion of the shutter flag abuts against a sheet and enters a wait state.
Figure 26B:
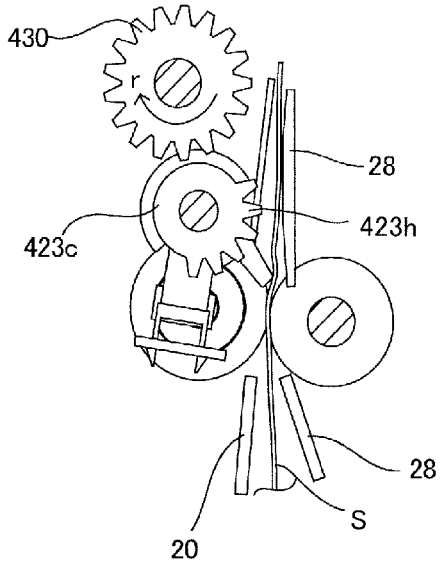
FIG. 26B illustrates the assist gear and the rotation assist gear in a state illustrated in FIG. 26A.
Figure 26C:
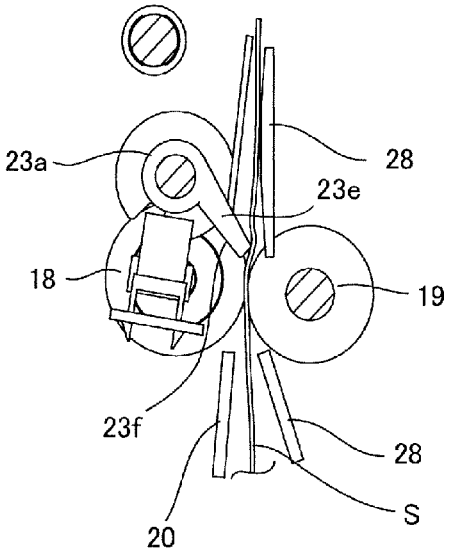
FIG. 26C illustrates the shutter flag in a state illustrated in FIG. 26A.
Figure 26D:
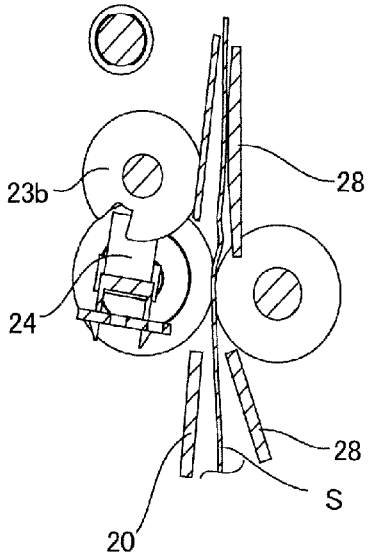
FIG. 26D illustrates the light shielding portion in a state illustrated in FIG. 26A.

FIG. 25A illustrates a state in which the assist gear engages with the rotation assist gear. FIG. 25B illustrates the assist gear and the rotation assist gear in a state illustrated in FIG. 25A. FIG. 25C illustrates the shutter flag in a state illustrated in FIG. 25A. FIG. 25D illustrates the light shielding portion in a state illustrated in FIG. 25A. FIG. 26A illustrates a state in which the abutting portion 23*e* of the shutter flag abuts against a sheet and enters a wait state. FIG. 26B illustrates the assist gear and the rotation assist gear in a state illustrated in FIG. 26A. FIG. 26C illustrates the shutter flag in a state illustrated in FIG. 26A. FIG. 26D illustrates the light shielding portion in a state illustrated in FIG. 26A.

The fourth embodiment is different from the first embodiment in that the image forming apparatus 100C of the fourth embodiment uses an assist gear 423*c* and a rotation assist gear 430. Thus, the description of the fourth embodiment will focus on the difference from the first embodiment, namely, the assist gear 423*c* and the rotation assist gear 430. In the fourth embodiment, the same reference numerals or characters are assigned to the same components as those of the image forming apparatus 100 according to the first embodiment and the description thereof is omitted. In the fourth embodiment, the same components as those of the first embodiment exert the same effects as those of the first embodiment.

Referring to FIG. 1, the entire structure of the image forming apparatus 100C according to the fourth embodiment will be described. As illustrated in FIG. 1 and FIGS. 23A to 26D, the image forming apparatus 100C according to the fourth embodiment includes a sheet feeding portion 8, an image forming portion 14, a fixing portion 10, a sheet conveying portion 9C, and a sheet discharging portion 13.

The sheet conveying portion 9C includes a sheet conveying path 15*a*, a duplex conveying path 15*b*, an oblique feed roller pair 16, a U-turn roller pair 17, the paper feed frame 20, a guide frame 28, a conveying roller pair 18, 19, and the sheet detection portion 22C. The sheet detection portion 22C includes a sensor flag 23C, an optical sensor 24, a shutter driving portion 25, a shutter spring 27, and the rotation assist gear 430 as a rotation portion. The sensor flag 23C includes a shutter flag 23*a*, a light shielding portion 23*b*, the assist gear 423*c*, and a flag rotating shaft 23*d*.

The rotation assist gear 430 is formed into a gear shape whose outer peripheral surface has a plurality of teeth. The assist gear 423*c* is arranged in a predetermined range of the outer peripheral surface thereof and includes an interrupted toothed portion 423*h* as an interrupted toothed gear meshing with the rotation assist gear 430. After an abutment surface 23*f* of the shutter flag 23*a* is pushed by a sheet S to rotate up to a predetermined rotational position, the interrupted toothed portion 423*h* engages with the rotation assist gear 430 until a drive projection portion 25*b* of the shutter driving portion 25 rotates and exceeds the top dead center.

Referring to FIGS. 24A to 26D, the operation of the sheet detection portion 22C will be described. As illustrated in FIGS. 24A and 24C, in a state in which the leading end of the sheet S does not abut against the abutment surface 23*f* of the shutter flag 23*a*, the abutting portion 23*e* of the shutter flag 23*a* is held in a wait state at the home position by the biasing force of the shutter spring 27. As illustrated in FIG. 24B, at the home position, the interrupted toothed portion 423*h* of the assist gear 423*c* is spaced apart from the rotation assist gear 430, and the rotational driving force of the rotation assist gear 430 is not transmitted to the interrupted toothed portion 423*h* of the assist gear 423*c*. Further, as illustrated in FIG. 24D, an optical path L of the optical sensor 24 is allowed to pass through a slit portion 23*g* of the light shielding portion 23*b*.

As illustrated in FIG. 25A, when the shutter flag 23*a* further rotates, the interrupted toothed portion 423*h* of the assist gear 423*c* engages with the rotation assist gear 430 rotating in a direction indicated by an arrow r. As illustrated in FIG. 25B, when the interrupted toothed portion 423*h* of the assist gear 423*c* engages with the rotation assist gear 430, the rotational driving force of the rotation assist gear 430 is transmitted to the interrupted toothed portion 423*h* and the assist gear 423*c* rotates in a direction indicated by an arrow z. At a time when the interrupted toothed portion 423*h* engages with the rotation assist gear 430, the force for rotating the sensor flag 23C is switched from the conveying force of the sheet S to the rotational driving force of the rotation assist gear 430, the state of which continues up to the state in which the drive projection portion 25*b* of the shutter driving portion 25 exceeds the top dead center. As illustrated in FIG. 25C, the rotation of the assist gear 423*c* rotates the sensor flag 23C in the same direction (as the direction indicated by an arrow z), causing the abutting portion 23*e* (abutment surface 23*f*) of the shutter flag 23*a* to retract from the sheet S. As illustrated in FIG. 25D, also in this state, the optical path L of the optical sensor 24 is shielded by the light shielding portion 23*b*.

At substantially the same time as when the drive projection portion 25*b* of the shutter driving portion 25 reaches the top dead center, the interrupted toothed portion 423*h* of the assist gear 423*c* becomes spaced apart from the rotation assist gear 430. When the interrupted toothed portion 423*h* becomes spaced apart from the rotation assist gear 430, the subsequent rotation of the sensor flag 23C is performed by the biasing force of the shutter spring 27. When the sensor flag 23C rotates in a direction indicated by an arrow z by the biasing force of the shutter spring 27, as illustrated in FIGS. 26A and 26B, the abutting portion 23*e* of the shutter flag 23*a* abuts against the surface of the sheet S conveyed by the conveying roller pair 18, 19. The biasing force of the shutter spring 27 biases the shutter flag 23*a* to return the shutter flag 23*a* to the home position, but the shutter flag 23*a* cannot return to the home position until the sheet S passes therethrough because the sheet S is conveyed. Accordingly, as illustrated in FIG. 26C, in a state of being biased by the shutter spring 27, the shutter flag 23*a* abuts against the surface of the sheet S to enter a wait state. As illustrated in FIG. 26D, also in this state, the optical path L of the optical sensor 24 is shielded by the light shielding portion 23*b*.

When the sheet S is further conveyed and the trailing end of the sheet S passes through the shutter flag 23*a*, the shutter flag 23*a* rotates in a direction indicated by an arrow z. When the shutter flag 23*a* rotates in a direction indicated by an arrow z, the light shielding portion 23*b* is released from shielding of the optical path L of the optical sensor 24. Then, the optical sensor 24 generates a transmission signal. Thus, the trailing end of the sheet S can be detected.

When the trailing end of the sheet S moves away from the shutter flag 23*a*, the sensor flag 23C is rotated by a rotational force generated by the shutter spring 27 and the shutter driving portion 25. Then, the abutment surface 23*f* of the shutter flag 23*a* enters a wait state at the home position for detecting the subsequent sheet S as illustrated in FIG. 24A.

The image forming apparatus 100C according to the fourth embodiment having the above configuration can exert not only the effects resulting from the same configuration as that of the first embodiment but also the following effects. The sheet detection portion 22C according to the fourth embodiment meshes the rotation assist gear 430 with the interrupted toothed portion 423*h* of the assist gear 423*c* to rotate the sensor flag 23C. Accordingly, the fourth embodiment can suppress slippage due to wear of rollers and cams more than the configuration of engaging the rotation assist roller 30 with the assist cam 23*c*. Thus, the fourth embodiment can assure more reliable meshing and can increase meshing reliability.

<Fifth Embodiment>

Figure 27:
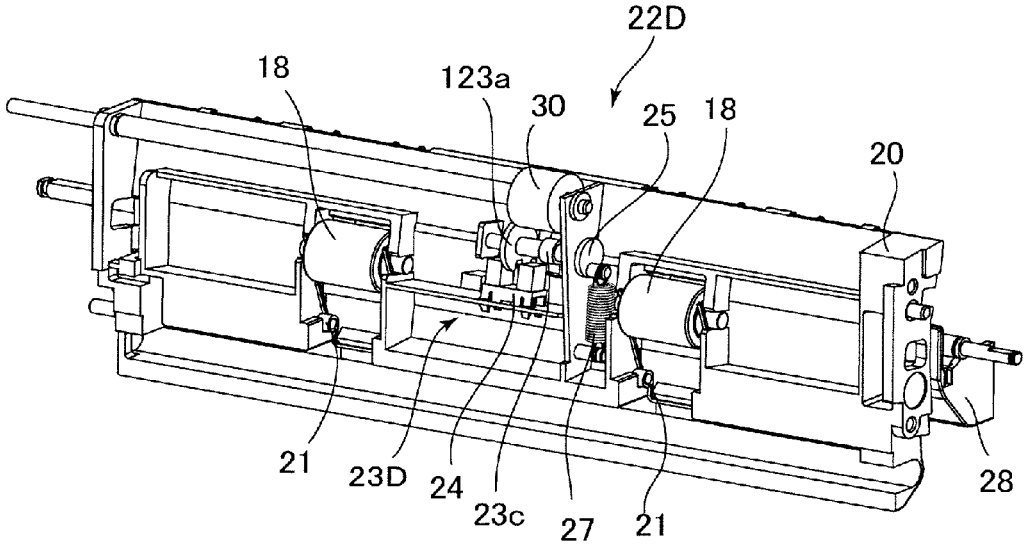
FIG. 27 is a perspective view illustrating a sheet detection portion supported by a paper feed frame according to a fifth embodiment.
Figure 28:
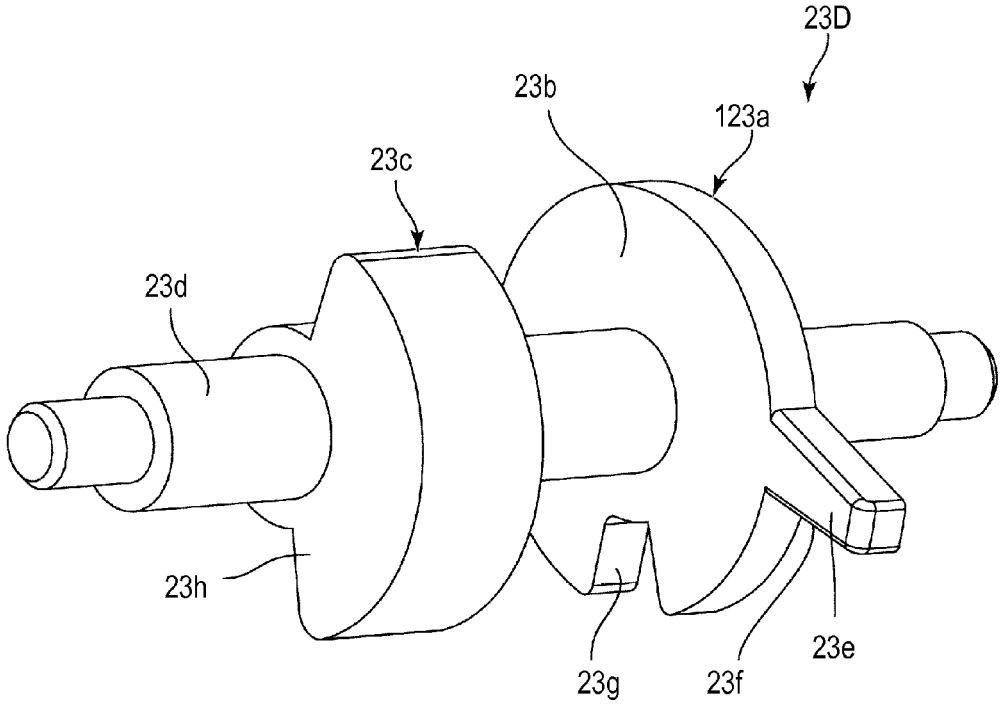
FIG. 28 is a perspective view illustrating a sensor flag of the sheet detection portion according to the fifth embodiment.
Figure 29:
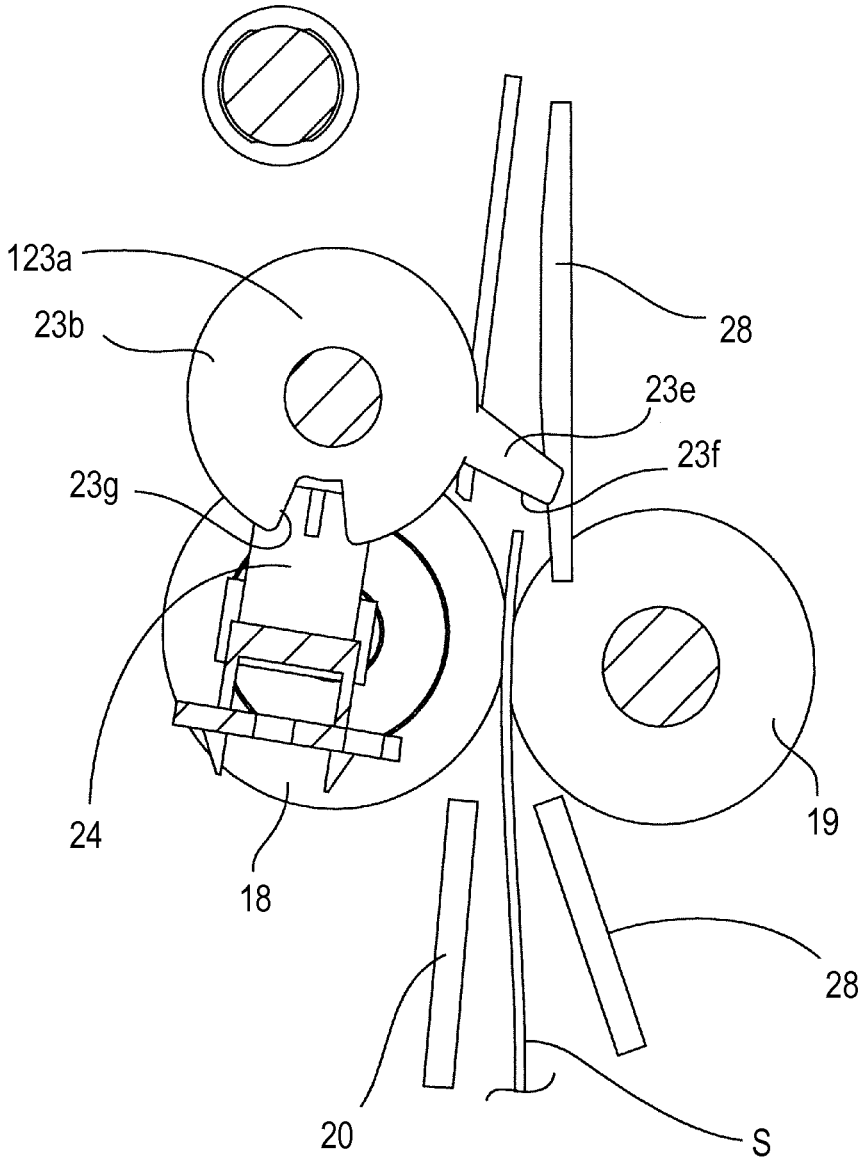
FIG. 29 illustrates the sheet detection portion according to the fifth embodiment.
Figure 30:
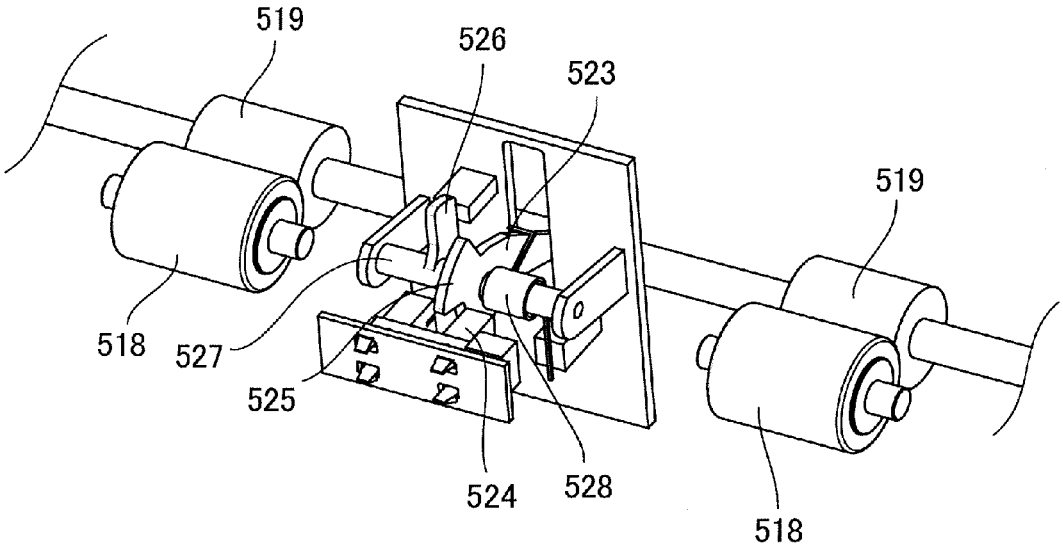
FIG. 30 is a perspective view illustrating a sheet detection portion according to a conventional image forming apparatus.
Figure 31A:
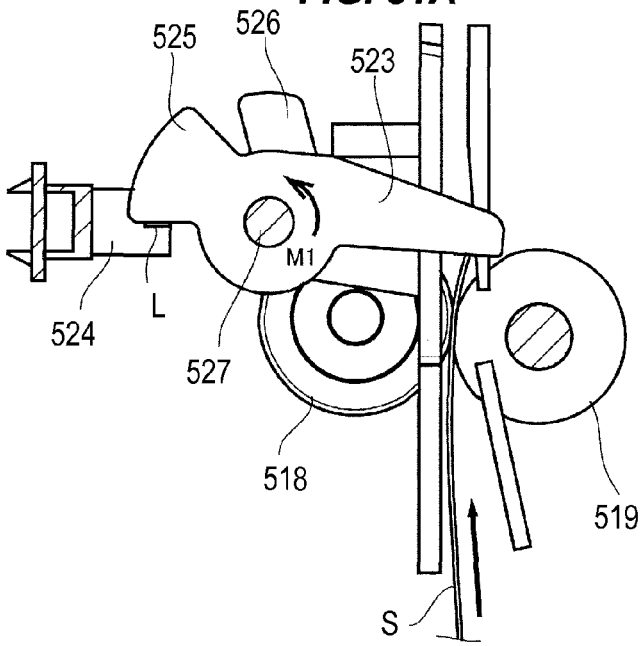
FIG. 31A illustrates an operation of a shutter flag according to the conventional sheet detection portion illustrated in FIG. 30.
Figure 31B:
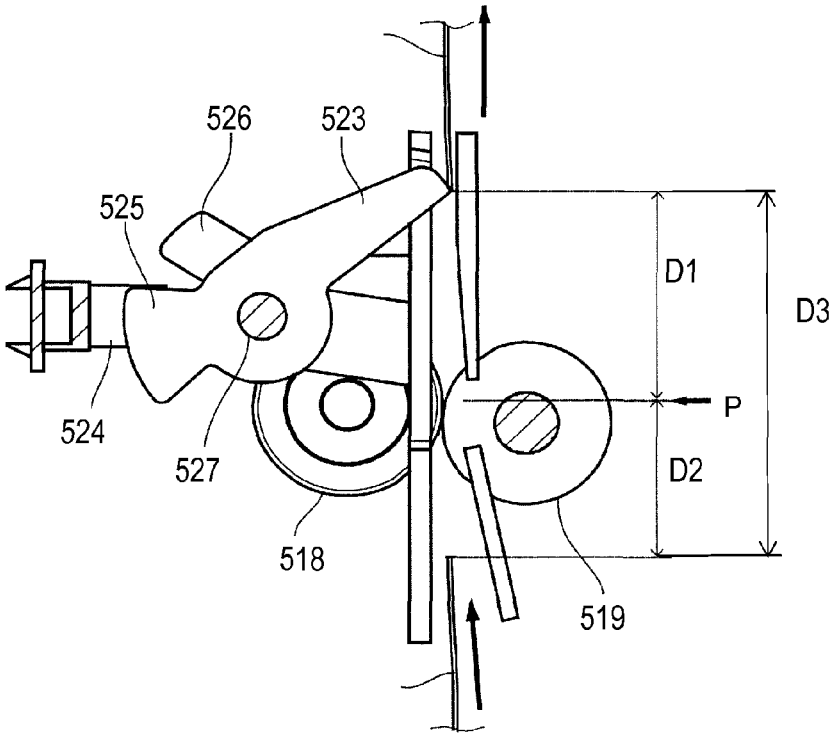
FIG. 31B illustrates an operation of the shutter flag according to the conventional sheet detection portion illustrated in FIG. 30.

Referring to FIG. 1 and further referring to FIGS. 27 to 29, the entire structure of an image forming apparatus 100D according to a fifth embodiment of the present invention will be described. FIG. 27 is a perspective view illustrating a sheet detection portion 22D supported by a paper feed frame 20 according to the fifth embodiment. FIG. 28 is a perspective view illustrating a sensor flag 23D of the sheet detection portion 22D according to the fifth embodiment. FIG. 29 illustrates the sheet detection portion 22D according to the fifth embodiment.

The image forming apparatus 100D of the fifth embodiment is different from the first embodiment in that a light shielding portion 23*b* and a slit portion 23*g* are provided on a shutter flag 123*a* having an abutting portion 23*e*. Thus, the description of the fifth embodiment will focus on the difference from the first embodiment, namely, the shutter flag 123*a*. In the fifth embodiment, the same reference numerals or characters are assigned to the same components as those of the image forming apparatus 100 according to the first embodiment and the description thereof is omitted. That is, in the fifth embodiment, the same components as those of the first embodiment exert the same effects as those of the first embodiment.

Referring to FIG. 1, the entire structure of the image forming apparatus 100D according to the fifth embodiment will be described. As illustrated in FIGS. 1 and 27, the image forming apparatus 100D according to the fifth embodiment includes a sheet feeding portion 8, an image forming portion 14, a fixing portion 10, a sheet conveying portion 9D, and a sheet discharging portion 13.

The sheet conveying portion 9D includes a sheet conveying path 15*a*, a duplex conveying path 15*b*, an oblique feed roller pair 16, a U-turn roller pair 17, the paper feed frame 20, a guide frame 28, a conveying roller pair 18, 19, and the sheet detection portion 22D. The sheet detection portion 22D includes the sensor flag 23D, an optical sensor 24, a shutter driving portion 25, a shutter spring 27, and a rotation assist roller 30. As illustrated in FIG. 28, the sensor flag 23D includes the shutter flag 123*a*, an assist cam 23*c*, and a flag rotating shaft 23*d*.

The shutter flag 123*a* includes the abutting portion 23*e* which can abut against the leading end of a sheet S conveyed by the conveying roller pair 18, 19; the light shielding portion 23*b* as a rotation detection portion; and the slit portion 23*g* passing light from the optical sensor 24.

The image forming apparatus 100D according to the fifth embodiment having the above configuration can exert not only the effects resulting from the same configuration as that of the first embodiment but also the following effects. In the sheet detection portion 22D according to the fifth embodiment, the shutter flag 123*a* and the light shielding portion 23*b* are made of the same member. The abutting portion 23*e*, the light shielding portion 23*b* and the slit portion 23*g* are formed from the same member. Accordingly, when providing the shutter flag 123*a*, costs can be reduced and space can be saved.

Hereinbefore, the embodiments of the present invention have been described, but the present invention is not limited to the aforementioned embodiments. In addition, the effects described in the embodiments of the present invention are merely a listing of exemplary effects deriving from the present invention and thus the effects of the present invention are not limited to the description of the embodiments of the present invention.

For example, in the first embodiment, the rotation assist roller 30 is arranged independently, but the present invention is not limited to this. For example, the rotation assist roller 30 may be arranged on the rotating shaft 19*a* of the conveying rollers 19 so as to face the assist cam 23*c* integrally formed with the sensor flag 23. This arrangement can reduce costs and save space more than the independent arrangement of the rotation assist roller 30.

In addition, the third embodiment describes that the sheet detection portion 22B detects the sheet S, and the image is formed so as to be matched with the sheet based on the signal from the sheet detection portion 22B, but the present invention is not limited to this. For example, a configuration may be made such that first, the image formation is performed and after the sheet S is detected by the sheet detection portion 22, the sheet is positioned to the image.

In the present embodiment, the biasing force of the shutter spring 27 is used to return the sensor flag to the home position, but the present invention is not limited to this. For example, a configuration may be made such that the sensor flag returns to the home position by adjusting the weight balance of the sensor flag or using gravitational force.

In the fourth embodiment, the shutter spring 27 is mounted on the drive projection portion 25*b* of the shutter driving portion 25, but the present invention is not limited to this. For example, the shutter spring 27 may be mounted on the assist gear 423*c*.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-230415, filed Oct. 13, 2010, which is hereby incorporated by reference herein in its entirety.

What is claimed is:

1. A sheet conveying apparatus comprising:

a conveying portion configured to convey a sheet;

a rotating portion configured to have an abutting portion which abuts against a leading end of the sheet conveyed by the conveying portion at a waiting position, wherein the rotating portion is rotated in a predetermined rotational direction by the abutting portion being pushed by the leading end of the sheet, and the rotating portion locates at the waiting position, where a leading end of a subsequent sheet abuts against the abutting portion, by rotating in the predetermined rotational direction after a leading end of a preceding sheet abuts against the abutting portion;

a sensor portion configured to detect the sheet to be conveyed based on a rotational position of the rotating portion; and a rotation transmission portion configured to transmit a rotational driving force to the rotating portion to rotate the rotating portion in the predetermined rotational direction after the rotating portion is rotated by being pushed by the leading end of the sheet to be conveyed.

2. The sheet conveying apparatus according to claim 1, further comprising:

an urging unit configured to apply an urging force to the rotating portion after the rotating portion is rotated in the predetermined rotational direction by the rotational driving force transmitted by the rotation transmission portion so that the rotating portion is rotated in the predetermined rotational direction to locate at the waiting position.

3. The sheet conveying apparatus according to claim 1, wherein, the rotation transmission portion includes:

a rotation member configured to be rotated by driving force transmitted from a motor; and a transmission portion coupled to the rotating portion and configured to transmit the rotational driving force to the rotating portion by engaging with the rotation member, wherein the transmission portion is apart from the rotation member portion when the rotating portion is at the waiting position, and the transmission portion engages with the rotation member and applies the rotational driving force to rotate in the predetermined rotational direction to the rotating portion, after the abutting portion is pushed by the leading end of the sheet and the rotating portion rotates up to a predetermined rotational position for changing a signal output from the sensor portion.

4. The sheet conveying apparatus according to claim 3, wherein the rotation member is a roller, and the rotational driving force is transmitted to the rotating portion by an outer peripheral surface of the transmission portion contacting with the roller.

5. The sheet conveying apparatus according to claim 3, wherein the rotation member has a gear shape whose outer peripheral surface has a tooth, and the transmission portion has an interrupted toothed gear arranged in a predetermined range on an outer peripheral surface of the transmission portion and meshing with the tooth of the rotation member.

6. The sheet conveying apparatus according to claim 3, wherein the rotating portion is rotated in the predetermined rotational direction by transmitting the rotational driving force with the rotation transmission portion, and the rotating portion contacts with a surface of the conveyed sheet.

7. The sheet conveying apparatus according to claim 6, wherein the transmission portion is apart from the rotation member in a state that the rotating portion contacts with a surface of the passing sheet.

8. The sheet conveying apparatus according to claim 3, wherein the sensor portion has a light emitting portion and a light receiving portion, the rotating portion has a light shielding portion shielding light to be received by the light receiving portion, and the rotating portion rotates and the light shielding portion shields light to be received by the light receiving portion, thereby a leading end position of the conveyed sheet is detected.

9. The sheet conveying apparatus according to claim 1, wherein the rotating portion is rotated in the predetermined rotational direction by transmitting the rotational driving force with the rotation transmission portion, and the rotating portion contacts with a surface of the conveyed sheet.

10. The sheet conveying apparatus according to claim 9, further comprising:

an urging unit configured to apply an urging force to the rotating portion so that the rotating portion is rotated in the predetermined rotational direction to move to the waiting position while a tail end of the sheet passes from a state that the rotating portion contacts with the surface of the conveyed sheet.

11. A sheet conveying apparatus comprising:

a conveying portion configured to convey a sheet;

a rotating portion configured to have a plurality of abutting portions which are arranged in a circumferential direction and abuts against a leading end of the sheet conveyed by the conveying portion, wherein the rotating portion is rotated in a predetermined rotational direction by the abutting portion being pushed by the leading end of the sheet, and the rotating portion locates at a waiting position, where a leading end of a subsequent sheet abuts against one abutting portion of the plurality of abutting portions, by rotating in the predetermined rotational direction after a leading end of a preceding sheet abuts against another abutting portion of the plurality of abutting portions;

a sensor portion configured to output a signal corresponding to a rotational position of the rotating portion; and a rotation transmission portion configured to transmit a rotational driving force to the rotating portion to rotate the rotating portion in the predetermined rotational direction after the rotating portion is rotated by being pushed by the leading end of the sheet to be conveyed.

12. The sheet conveying apparatus according to claim 11, further comprising:

an urging unit configured to apply an urging force to the rotating portion after the rotating portion is rotated in the predetermined rotational direction by the rotational driving force transmitted by the rotation transmission portion so that the rotating portion is rotated in the predetermined rotational direction to locate at the waiting position.

13. The sheet conveying apparatus according to claim 11, wherein, the rotation transmission portion includes:

a rotation member configured to be rotated by driving force transmitted from a motor; and a transmission portion coupled to the rotating portion and configured to transmit the rotational driving force to the rotating portion by engaging with the rotation member, wherein the transmission portion is apart from the rotation member portion when the rotating portion is at the waiting position, and the transmission portion engages with the rotation member and applies the rotational driving force to rotate in the predetermined rotational direction to the rotating portion, after the abutting portion is pushed by the leading end of the sheet and the rotating portion rotates up to a predetermined rotational position for changing a signal output from the sensor portion.

14. The sheet conveying apparatus according to claim 13, wherein the rotation member is a roller, and the rotational driving force is transmitted to the rotating portion by an outer peripheral surface of the transmission portion contacting with the roller.

15. The sheet conveying apparatus according to claim 13, wherein the rotation member has a gear shape whose outer peripheral surface has a tooth, and the transmission portion has an interrupted toothed gear arranged in a predetermined range on an outer peripheral surface of the transmission portion and meshing with the tooth of the rotation member.

16. The sheet conveying apparatus according to claim 13, wherein the rotating portion is rotated in the predetermined rotational direction by transmitting the rotational driving force with the rotation transmission portion, and the rotating portion contacts with a surface of the conveyed sheet.

17. The conveying portion according to claim 16, wherein the transmission portion is apart from the rotation member in a state that the rotating portion contacts with a surface of the passing sheet.

18. The sheet conveying apparatus according to claim 13, wherein the sensor portion has a light emitting portion and a light receiving portion, the rotating portion has a light shielding portion shielding light to be received by the light receiving portion, and the rotating portion rotates and the light shielding portion shields light to be received by the light receiving portion, thereby a leading end position of the conveyed sheet is detected.

19. The sheet conveying apparatus according to claim 11, wherein the rotating portion is rotated in the predetermined rotational direction by transmitting the rotational driving force with the rotation transmission portion, and the rotating portion contacts with a surface of the conveyed sheet.

20. The sheet conveying apparatus according to claim 19, further comprising:

an urging unit configured to apply an urging force to the rotating portion so that the rotating portion is rotated in the predetermined rotational direction to move to the waiting position while a tail end of the sheet passes from a state that the rotating portion contacts with the surface of the conveyed sheet.

* * * * *